US012600513B2

(12) United States Patent
Yang et al.

(10) Patent No.: US 12,600,513 B2
(45) Date of Patent: Apr. 14, 2026

(54) CONVEYING MODULE AND CONVEYING DEVICE FOR PACKING MACHINE

(71) Applicant: CHENGDU MEIJINDI TECHNOLOGIES LTD, Chengdu (CN)

(72) Inventors: Xiaowei Yang, Chengdu (CN); Renwang Xiao, Chengdu (CN)

(73) Assignee: CHENGDU MEIJINDI TECHNOLOGIES LTD, Chengdu (CN)

( * ) Notice: Subject to any disclaimer, the term of this patent is extended or adjusted under 35 U.S.C. 154(b) by 35 days.

(21) Appl. No.: 18/897,002

(22) Filed: Sep. 26, 2024

(65) Prior Publication Data

US 2025/0108948 A1 Apr. 3, 2025

(30) Foreign Application Priority Data

Sep. 28, 2023 (CN) ..... 202311284390.5
Sep. 28, 2023 (CN) ..... 202311284465.X

(51) Int. Cl.
*B65B 43/30* (2006.01)
*B65B 43/52* (2006.01)
*B65B 59/00* (2006.01)

(52) U.S. Cl.
CPC ..... *B65B 43/30* (2013.01); *B65B 43/52* (2013.01); *B65B 59/003* (2019.05)

(58) Field of Classification Search
CPC ..... B65B 43/30; B65B 43/32; B65B 43/465; B65B 43/52; B65B 43/54; B65B 59/001; B65B 59/003; B65B 59/005; B65B 59/02
See application file for complete search history.

(56) References Cited

U.S. PATENT DOCUMENTS 5,058,364 A * 10/1991 Seiden ..... B65B 43/123 53/562
5,673,541 A 10/1997 Arzuman et al.
(Continued)

FOREIGN PATENT DOCUMENTS

CN 115636143 A 1/2023
JP 7213524 B2 1/2023

OTHER PUBLICATIONS

European Partial Search Report issued on Apr. 28, 2025 for the European counterpart application No. 24201881.0.

*Primary Examiner* — Himchan Song
(74) *Attorney, Agent, or Firm* — Yue (Robert) Xu; Apex Attorneys at Law, LLP

(57) ABSTRACT

A conveying module and a conveying device for a packing machine are provided. The conveying module for the packing machine is provided on the circulating conveyor mechanism, and includes a modular pedestal on which a telescopic linkage mechanism and at least two holding units arranged in parallel for placing packing bags are provided. Each holding unit includes left and right holding components engaged with sides of the packing bag and movable relative to each other. The telescopic linkage mechanism synchronously is configured to enable the left and right holding components to move relative to each other, so as to drive all the holding units to synchronously switch between a bag deployed attitude and a bag retracted attitude. The spacing distance of the left and right holding components in the bag deployed attitude is larger than that in the bag retracted attitude.

13 Claims, 26 Drawing Sheets

(56) References Cited

U.S. PATENT DOCUMENTS

| | | | | |
|---|---|---|---|---|
| 6,050,061 | A * | 4/2000 | Todd | B65B 5/022 53/562 |
| 6,276,117 | B1 * | 8/2001 | Wiles | B65B 43/465 53/384.1 |
| 2003/0233812 | A1 * | 12/2003 | Rogers | B65B 61/186 53/469 |
| 2009/0113850 | A1 * | 5/2009 | Beinghaus | B65B 43/465 53/468 |
| 2009/0272074 | A1 * | 11/2009 | Kurz | B65B 59/005 53/284.7 |
| 2025/0108948 | A1 * | 4/2025 | Yang | B65B 43/465 |

* cited by examiner

CONVEYING MODULE AND CONVEYING DEVICE FOR PACKING MACHINE

CROSS REFERENCE OF RELATED APPLICATION

This application claims priority to Chinese Patent Application No. 202311284390.5, titled "CONVEYING DEVICE FOR PACKING MACHINE AND PACKING MACHINE", filed on Sep. 28, 2023 with the China National Intellectual Property Administration, and to Chinese Patent Application No. 202311284465.X, titled "PACKING BAG OPERATION MODULE FOR PACKING MACHINE", filed on Sep. 28, 2023 with the China National Intellectual Property Administration, which are incorporated herein by reference in its entirety.

FIELD

The present application relates to a technical field of packing equipment, and in particular to a conveying module and a conveying device for a packing machine.

BACKGROUND

A packaging machine usually stacks and places several bags of raw materials in the bag storage unit of equipment, and then uses the bag taking mechanism to automatically take out the bags one by one from the bag storage unit, and then performs operations of opening the bag, charging, sealing the bag and discharging sequentially, ultimately getting the finished bag filled with materials and sealed. The existing automatic bag filling and sealing machine includes a variety of structural forms, but usually is of the circulating conveyor structure with a single station, i.e., can perform the opening, charging, sealing and discharging operations sequentially only for a single bag at one time, resulting in a low efficiency. In the prior art there is also a packaging machine which operates a number of bags simultaneously but has a serial type circulating conveyor mechanism, that is, several stations are provided in a group along the direction of conveying path of the circulating conveyor mechanism. Specifically, offline mechanisms such as bag loading mechanism, bag opening mechanism, charging mechanism, sealing mechanism and discharging mechanism are arranged in turn along the conveying direction of the circulating conveyor mechanism, and these offline mechanisms each include multiple processing stations arranged along the conveying direction of the circulating conveyor mechanism. With this structure, the packaging processing of multiple bags may be theoretically performed at the same time, but it will result in an overlong overall return travel, a complex structure, an excessive footprint of the circulating conveyor mechanism, and each bag actually needs to travel across the travel length covered by a plurality of stations in order to travel to the next offline mechanism to carry out the next packaging processing operation. It will lead to a relatively large proportion of the traveling time. Therefore, the efficiency is actually low, and it is impossible to realize efficient and stable packaging production.

SUMMARY

The technical problem to be solved and the proposed technical task of the present application are to improve the existing technology to provide conveying module and a conveying device for a packaging machine, which may solve the problem of a complicated structure, a large footprint and/or difficulty in realizing efficient and stable packaging production occurred in the packaging machine in the prior art.

In order to solve the above problem, the present application provides the following solutions.

A conveying module for a packing machine includes a modular pedestal. A telescopic linkage mechanism and at least two holding units are provided on the modular pedestal, the holding units being arranged in parallel for placing packing bags. Each holding unit includes a left holding component and a right holding component which are configured to be engaged with sides of the packing bag respectively and are movable relative to each other. The telescopic linkage mechanism is configured to enable the left holding components and the right holding components to move relative to each other, so as to drive all the holding units to synchronously switch between a bag deployed attitude and a bag retracted attitude, and a spacing distance between the left holding component and the right holding component in the bag deployed attitude is larger than that in the bag retracted attitude. The conveying module for the packing machine according to the present application is provided with multiple holding units arranged in parallel, and simultaneously carries out various packaging processing operations for multiple packing bags in the parallel state, effectively improving the overall packaging processing efficiency. Compared with the existing series multi-station packaging processing, the present application adopts the parallel multi-station packaging processing. The holding units on the conveying module for the packing machine of the present application are not arranged in the conveying direction of the circulating conveyor mechanism. Increasing the number of the holding units arranged in parallel in the conveying module for the packing machine may not result in an increase in the length of the loop stroke of the circulating conveyor mechanism of the packing machine, that is, the circulating conveyor mechanism is able to maintain a relatively short length of the loop stroke, so as to increase the number of parallel processing and keep the structure of the equipment compact. The volume of the overall equipment may not be increased excessively, and the operation efficiency is higher. The dynamic and static time ratio is more reasonable when packaging processing, better improving the production efficiency and realizing the efficient and stable packaging production. Furthermore, the holding units on the conveying module for the packing machine of the present application are driven by the telescopic linkage mechanism to act synchronously. The structure is highly integrated, more compact, and reduces the occupied volume. When the holding unit is in the bag deployed attitude, the packing bag is straightened and flattened; and when the holding unit is in the bag retracted attitude, the both sides of the packing bag are close to each other to allow the packing bag to be in a loosened state, thereby facilitating opening the mouth of the packing bag. The packaging processing operations such as bag loading, filling and sealing have different requirements on the attitude of the packing bag. All the holding units are driven by the telescopic linkage mechanism to switch synchronously the attitudes, ensuring the stability and quality of various packaging processing operations.

Further, a bag width adjusting mechanism is provided on the modular pedestal, and is associated with at least one of the left holding component and the right holding component to synchronously adjust the spacing distance between the left holding component and the right holding component of each holding unit to adapt to packing bags of different sizes.

Only a small adjustment of the spacing distance of jig for clamping the both sides of the packing bag is needed to achieve the bag deployed and retracted actions required for packing processing, so that the packing bag is straightened or in the loosened state. The existing packaging machine is usually only applicable to a single size of the packing bag. When the size of the packing bag changes, the traditional packing machine cannot make the packing bag with changed size straight or in the loosened state, since it can perform a small change of the spacing distance of the jig only for a single size of the packing bag to achieve the bag deployed and retracted actions and thus cannot meet the requirement of packing processing. The conveying module for the packing machine of the present application can use the telescopic linkage mechanism to synchronously adjust the spacing distance between the left and right holding components to carry out the bag deployed and retracted actions, and can use the bag width adjusting mechanism to substantially adjust the spacing distance between the left and right holding components to adapt to the packing bags of different sizes, and the bag width adjusting mechanism does not hinder the action of the telescopic linkage mechanism. That is, after the bag width adjusting mechanism performs the bag width adjustment, the telescopic linkage mechanism still can adjust reliably and normally the spacing distance between the left and right holding components in a small range, which ensures stable and reliable packaging processing while matching the packing bags of different sizes.

Further, the bag width adjusting mechanism is associated with the telescopic linkage mechanism, and is associated with at least one of the left holding component and the right holding component via the telescopic linkage mechanism. The structure is more compact and simplified. The telescopic linkage mechanism is an adjusting mechanism for adjusting the spacing distance between the left holding component and the right holding component. The bag width adjusting mechanism is associated with the telescopic linkage mechanism, and then adjusts the state of the telescopic linkage mechanism, thereby indirectly adjusting the spacing distance between the left and right holding components via the telescopic linkage mechanism so as to adapt to the packing bags of different sizes. The bag width adjusting mechanism is appropriately combined with the telescopic linkage mechanism, and does not need too many linkage structures to be associated with at least one of the left and right holding components. The structure is more compact and simplified, is implemented more conveniently, and has a low cost.

Further, the bag width adjusting mechanism includes a limiting member and an elastic member. The limiting member is adjustably connected to the modular pedestal of the conveying module for the packing machine, and the elastic member is configured to act on a telescopic control member of the telescopic linkage mechanism to enable the telescopic control member to elastically abut against the limiting member. The bag width adjusting mechanism limits the telescopic control member of the telescopic linkage mechanism only on a single side. When adjusting, the limiting member drives the telescopic control member to move, so that the telescopic linkage mechanism changes the spacing distance between the left and right holding components, thereby matching the packing bags of different sizes. And, the bag width adjusting mechanism also maintains an elastic space for movement of the telescopic control member of the telescopic linkage mechanism. The telescopic control member can overcome the elastic member to move under drive of the telescopic drive mechanism. That is, after carrying out the bag width adjustment, the telescopic linkage mechanism can make a small adjustment of the spacing distance between the left and right holding components under drive of the telescopic drive mechanism, so as to achieve the bag deployed and retracted actions, thereby performing normally the packing processing while matching the packing bags of different sizes.

Further, the telescopic linkage mechanism includes telescopic linkage bars and a telescopic control member, and the telescopic linkage bars extend and are arranged along a direction of arrangement of the holding units. Each telescopic linkage bar is associated with at least one of the left holding component and the right holding component, and the telescopic control member is drivingly connected to the telescopic linkage bar, so as to drive the telescopic linkage bar to rotates around its axis or move in its axial direction, thereby causing relative movement of the left holding component and the right holding component. The structure is simple and compact, and is easily carried out. The telescopic linkage bar can be associated with at least one of the left and right holding components in any connecting manner. When the telescopic linkage bar rotates or axially moves, it at least drives one of the left and right holding components to move for adjustment.

Further, each telescopic linkage bar is provided with a first threaded section and a second threaded section which are oppositely threaded, wherein the left holding component is mounted on the first threaded section, the right holding component is mounted on the second threaded section, the telescopic linkage bar is configured to rotate around its axis to enable opposite movements of the left holding component and the right holding component in an axial direction of the telescopic linkage bar; or each telescopic linkage bar includes a first linkage bar and a second linkage bar parallel to each other, wherein the first linkage bar is connected to the left holding component, the second linkage bar is connected to the right holding component, the left holding component is slidably engaged with the second linkage bar, the right holding component is slidably engaged with the first linkage bar, the first linkage bar and the second linkage bar are movable in opposite axial directions; or each telescopic linkage bar is provided thereon with a pushing part, wherein the pushing part is configured to, when rotating around its axis or moving axially, push one of the left holding component and the right holding component to move. The structure is simple, easy to carry out, easy to adjust, and has good stability.

Further, the first linkage bar and the second linkage bar are connected through a reverse linkage mechanism such that, when one of the first linkage bar and second linkage bar moves axially, the other of the first linkage bar and second linkage bar is driven by the reverse linkage mechanism to move axially in a reverse direction. Only one of the first linkage bar and the second linkage bar is needed to drive, which is conducive to simplifying the telescopic drive mechanism. Only a single set of drive mechanism is needed, reducing the difficulty of the design and improving the compactness of the structure.

Further, the reverse linkage mechanism includes a first rack, a second rack and a first gear, wherein the first linkage bar is connected to the first rack, the second linkage bar is connected to the second rack, a length direction the first rack and the second rack is in accord with a direction of axis of the first linkage bar and the second linkage bar, the first rack and the second rack are space apart in parallel, the first gear is arranged between and meshed with the first rack and the second rack; or the reverse linkage mechanism includes a toggle lever, wherein a middle of the toggle lever is rotatably connected to the modular pedestal of the conveying module for the packing machine, one end of the toggle lever is drivingly connected to the first linkage bar through a structure of a groove-pin pair, the other end of the toggle lever is drivingly connected to the second linkage bar through a structure of a groove-pin pair. The structure is simple and compact, has a small footprint, is easy to implement, and has high reliability of linkage.

Further, the telescopic control member includes a telescopic control rack and a telescopic control gear. The telescopic control rack is slidably arranged on the modular pedestal of the conveying module for the packing machine, and the telescopic control gear is rotatably arranged on the modular pedestal. The telescopic control rack and the telescopic control gear are meshed with each other, the telescopic control gear is drivingly connected to the telescopic linkage bar such as to drive the telescopic linkage bar to rotate around its axis or move in its axial direction. The telescopic control rack can be conveniently cooperated with the telescopic drive mechanism, no matter the telescopic drive mechanism adopts the power actuating mechanism or the guiding member, which can conveniently and reliably drive the telescopic control rack to move. The linear motion of the telescopic control rack is converted into a rotational motion of the telescopic control gear through the mehsingly connection between the telescopic control rack and the telescopic control gear, and the rotating telescopic control gear drives the telescopic linkage bar to move. The connection structure between the telescopic control gear and the telescopic linkage bar may be flexibly designed according to the required action mode of the telescopic linkage bar.

Further, a limiting member and an elastic member are further included. The limiting member is adjustably connected to the modular pedestal of the conveying module for the packing machine in a sliding direction of the telescopic control rack, and the elastic member is arranged between the telescopic control rack and the modular pedestal and enables the telescopic control rack to elastically abut against the limiting member. The limiting member limits the telescopic control member of the telescopic linkage mechanism on a single side. When adjusting, the limiting member drives the telescopic control member to move, so that the telescopic linkage mechanism changes the spacing distance between the left and right holding components, thereby matching the packing bags of different sizes. And, the telescopic control member of the telescopic linkage mechanism has an elastic space for movement. The telescopic control member can overcome the elastic member to move under drive of the telescopic drive mechanism. That is, after carrying out the bag width adjustment, the telescopic linkage mechanism can make a small adjustment of the spacing distance between the left and right holding components under drive of the telescopic drive mechanism, so as to achieve the bag deployed and retracted actions, thereby performing normally the packing processing while matching the packing bags of different sizes.

Further, the left holding component and the right holding component each are a jig. The packing bag is fixed by clamping, having a good fixed stability and ensuring that the packing bag is always in a controlled state during packaging processing to improve the reliability of packaging processing. A clamping linkage mechanism is provided on the conveying module for the packing machine, and the clamping linkage mechanism is configured to drive the left holding components and the right holding components of all of the holding units to synchronously switch between a jig opened state and a jig closed state. When loading a bag, the jig needs to switch to the jig opened state to receive the incoming packing bag, and then switch to the jig closed state to clamp stably the packing bag. When discharging, the jig needs to switch to the jig opened state to release the processed packing bag. The clamping linkage mechanism is integrated on the conveying module for the packing machine, which is highly integrated. The linkage structure is adopted, which is compact and occupies less space. The drive is more convenient, since only one drive mechanism is needed, reducing the design difficulty of the drive mechanism and occupied space and effectively ensuring the consistency of the action of the holding units. The clamping linkage mechanism includes clamping linkage bars extending and arranged along a direction of arrangement of the holding units. Each clamping linkage bar is provided thereon with an actuating part associated with the left holding component and the right holding component. The actuating part is configured to, when the clamping linkage bar rotates around its axis or moves axially, drive the left holding component and the right holding component to synchronously switch between the jig opened state and the jig closed state. The structure is simple, is easy to implement, and has a good compactness, small footprint, and high linkage reliability.

Further, a scraping mechanism is further provided on the modular pedestal. In the process of packaging processing, the following situations may occur: the packing bag is not placed on the holding unit; the packing bag falls off from the holding unit; material leaks when filling; etc. The packing bag and material falling in apparatuses of the packing machine may affect the normal operation of the packing machine packing bag, and the scraping mechanism arranged on the modular pedestal can scrape and clean the packing bag and material during traveling of the conveying module for the packing machine, ensuring cleanliness of equipment and achieving the centralized recycling and reuse of leaking materials.

Further, the scraping mechanism includes a stationary element and a sliding element, wherein the stationary element is connected to the modular pedestal, the sliding element is slidably connected to the stationary element;

when the conveying module for the packing machine is in a preset positive attitude, the sliding element automatically slides relative to the stationary element and switches to a deployed state; when the conveying module for the packing machine is in a preset reverse attitude, the sliding element automatically slides relative to the stationary element and switches to a retracted state.

The scraping mechanism is of a telescopic structure, realizing retraction and deployment. When the conveying module for the packing machine is in a preset positive attitude, the scraping mechanism is in a deployed state so as to reliably realize the function of cleaning and centralized recovery of leaking materials. When the conveying module for the packing machine is in a preset reverse attitude, the scraping mechanism is retracted to reduce the occupied space, avoiding the interference of the conveying module for the packing machine in the process of traveling. The structure is highly contact, which is conducive to improving the overall compactness of the packaging machine and reducing the volume of the equipment.

A conveying device for a packing machine includes the above conveying module for the packing machine, and a circulating conveyor mechanism, wherein the conveying module for the packing machine is provided on the circulating conveyor mechanism such as to be driven by the circulating conveyor mechanism to circularly travel, and a telescopic drive mechanism is provided beside the circulating conveyor mechanism and in configured to drive the telescopic linkage mechanism. The conveying device for the packing machine described in the present application has a compact structure and a small footprint, realizes multi-station parallel conveying to carry out multi-station parallel packaging processing, effectively improves the packaging processing efficiency, and realizes highly efficient and stable packaging production. The telescopic drive mechanism arranged beside the circulating conveyor mechanism enables all the holding units to synchronously act by driving the telescopic linkage mechanism. The compact structure and high degree of integration can reduce the difficulty and complexity of the design of the telescopic drive mechanism, making the telescopic drive mechanism more simplified, and ensuring that the packing bag placed on the conveying module for the packing machine can be deployed and retracted efficiently and consistently.

Further, the telescopic drive mechanism includes a power actuating mechanism, or a guiding member provided along a conveying path of the circulating conveyor mechanism, or combination thereof. The power actuating mechanism refers to a mechanism capable of carrying out an action, which may be driven by a motor, cylinder, etc. The power actuating mechanism actively moves to drive the telescopic linkage mechanism, which further drives the holding unit to synchronously switch between the bag deployed attitude and the bag retracted attitude. The power actuating mechanism may be moved linearly, rotated, swung, etc. The guiding member has a changed guide path. The conveying module for the packing machine moves under drive of the circulating conveyor mechanism. By designing the path, shape or structure of the guiding member, the telescopic linkage mechanism may be automatically driven to move during movement of the conveying module for the packing machine. The guiding member is a stationary part without the need for providing a power source, thereby saving energy and having a high drive reliability.

Further, the power actuating mechanism includes a toggle member and a power assembly, wherein the toggle member is adjustably connected to and driven by the power assembly;

- the toggle member includes two toggle levers spaced apart and parallel to a conveying direction of the circulating conveyor mechanism;
- the toggle member includes a hoop part, the power assembly includes a tie rod, the hoop part is adjustably connected to and surrounds the tie rod;
- the guiding member includes a guide rail or a guide groove, the guiding member is adjustably arranged beside the circulating conveyor mechanism. The structure is simple and easy to adjusted, and can ensure the stability of connection after adjustment as well as the precision of driving the telescopic linkage mechanism.

The structure is simple and easy to implement. The toggle can reliably drive the telescopic linkage mechanism to carry out the action, but also does not hinder movement of the conveying module for the packing machine under drive of the circulating conveyor mechanism. And, the power actuating mechanism and the guiding member adopt an adjustable structure, and can be adjusted adaptively in conjunction with the telescopic linkage mechanism to increase the scope of application of the packaging machine.

Further, the circulating conveyor mechanism includes two guide rails which are arranged in parallel and each in a circular path. The conveying module for the packing machine is slidably connected to the guide rails. The conveying drive mechanism of the circulating conveyor mechanism drives the conveying module for the packing machine to travel along the guide rails intermittently. The structure is simple, has a good stability since the conveying module for the packing machine is carried by double guide rails stably, ensures the stability and precision of traveling of the conveying module for the packing machine, and thus ensures the stability and efficiency of the packaging processing.

Further, the modular pedestal includes two support plates spaced apart and slidably connected to the guide rails respectively. The telescopic linkage mechanism and the holding units arranged in parallel are disposed between the two support plates. The structure is simplified and compact. The direction of arranging the holding units in parallel is perpendicular to the direction of conveying the circulating conveyor mechanism, which is easy to dispose the holding units in parallel between the two support plates. The both ends of the conveying module for the packing machine are supported on the guide rails by the support plates for conveying and traveling. The holding units located between the support plates is in a hang state, and do not interfere with the circulating conveyor mechanism, facilitating various packaging processing operations Further, each guide rail includes arc sections and straight sections. The support plate is provided with a sliding part engaged with the guide rail. The sliding part includes a first guide wheel and a second guide wheel. The guide rail is sandwiched between the first guide wheel and the second guide wheel. Two first guide wheel and two second guide wheel may be provided. When the sliding part is located at the arc section and the straight section of the guide rail, the first guide wheel and the second guide wheel are in rolling contact with the guide rail, ensuring the smoothness of conveying of the conveying module for the packing machine, i.e., traveling stably and rapidly at both the arc section and straight section. Therefore, the operating stability and efficiency of the packing machine can be ensured.

A packing machine includes the above conveying device for the packing machine, and several operating mechanisms for carrying out different packaging processing operations respectively. The operating mechanisms are respectively provided at various preset stations on the conveying path of the conveying device for the packing machine. Each operating mechanism includes operating units, the number of which corresponds to the number of the holding units of the conveying module for the packing machine, thereby realizing multi-station packaging processing, effectively improving the packaging processing efficiency, and realizing efficiently and stably packaging production.

Compared with the prior art, the present application has the following advantageous.

The conveying module and conveying device for the packing machine according to the present application adopt a parallel structure, which realizes multi-station parallel conveying to carry out multi-station parallel packaging processing, effectively improving the overall production efficiency of packaging processing without excessively increasing the occupied space. The structure is compact. The structure of the linkage control is adopted, facilitating control, having a high consistency of the action, being simple in the structure and easy to implement.

REFERENCE NUMERALS IN THE DRAWINGS

| | |
|---|---|
| 200 circulating conveyor mechanism, | 201 guide rail, |
| 2021 first guide wheel, | 2022 second guide wheel, |
| 100 conveying module for packing machine, | 101 modular pedestal, |
| 102 receiving site, | 103 support plate, |
| 1 holding unit, | 11 left holding component, |
| 12 right holding component, | 111 jig primary body, |
| 112 jig secondary body, | 113jig elastic member, |
| 114 roller, | 115 first clamping plate, |
| 116 second clamping plate, | 117 first clamping part, |
| 118 second clamping part, | 119 clamping body, |
| 1191 clamping elastic member, | 1192 secondary clamping portion, |
| 13 gear part, | 2 telescopic linkage bar, |
| 21 first threaded section, | 22 second threaded section, |
| 23 pushing part, | 24 first linkage bar, |
| 25 second linkage bar, | 26 telescopic threaded section, |
| 31 first rack, | 32 second rack, |
| 33 first gear, | 34 toggle lever, |
| 41 telescopic control rack, | 42 telescopic control gear, |
| 43 pushing part, | 51 limiting member, |
| 52 elastic member, | 53 bag width linkage bar, |
| 54 bag width threaded section, | 55 coupling block, |
| 61 clamping linkage bar, | 62 actuating part, |
| 621 swing arm member, | 622 pushing rod, |
| 2021 first guide wheel, | 2022 second guide wheel, |
| 300 telescopic drive mechanism, | 301 power actuating mechanism, |
| 3011 toggle member, | 3012 power assembly, |
| 3013 hoop part, | 302 guiding member, |
| 401 bag loading mechanism, | 402 bag opening mechanism, |
| 403 filling mechanism, | 404 sealing mechanism, |
| 405 discharging mechanism, | 71 scraping mechanism, |
| 711 stationary element, | 712 sliding element, |

DETAILED DESCRIPTION

The technical solutions in the embodiments of the present application will be described clearly and completely in the following in conjunction with the embodiments of the present application. It is obvious that the described embodiments are only a part of the embodiments of the present application, but not all of the embodiments. Based on the embodiments of the present application, all other embodiments obtained by a person of ordinary skill in the art without creative efforts fall within the scope of protection of the present application.

A conveying module for a packing machine, a conveying device for a packing machine, and a packing machine are disclosed in embodiments of the present application, which adopt parallel multi-station structure to increase the number of packaging processing per unit of time, thereby effectively improving the productivity of packaging processing and realizing efficient and stable packaging production.

Figure 1:
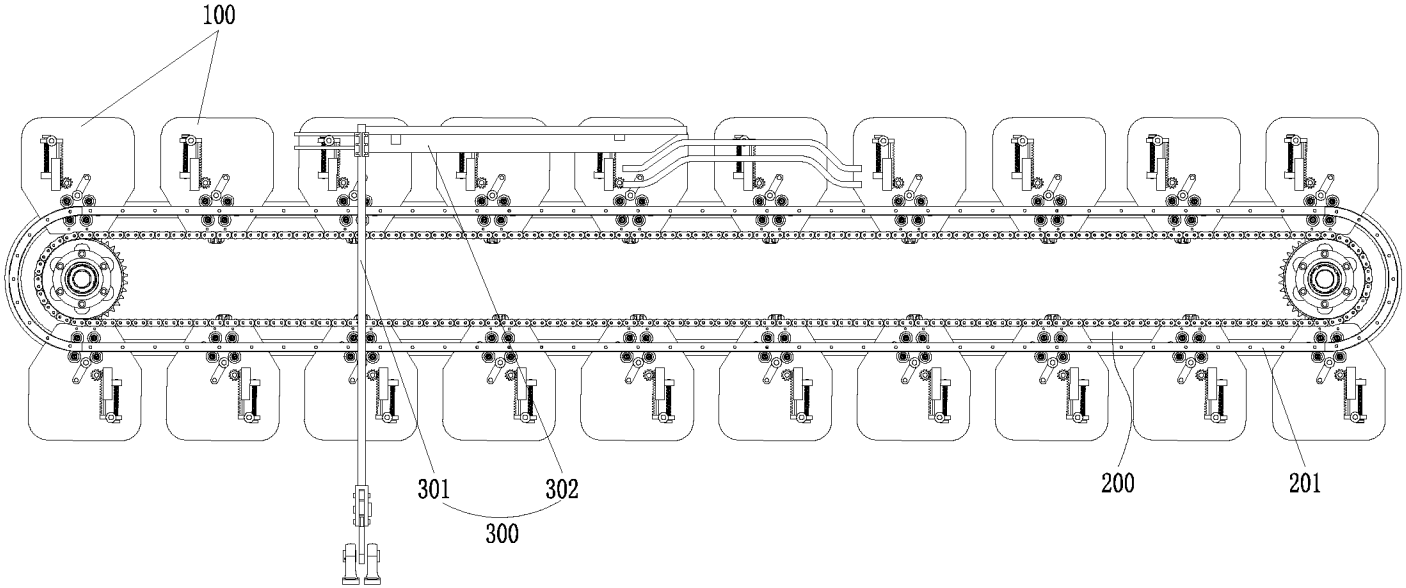
FIG. 1 is a schematic structural side view of a conveying device for a packing machine according to the present application.
Figure 2:
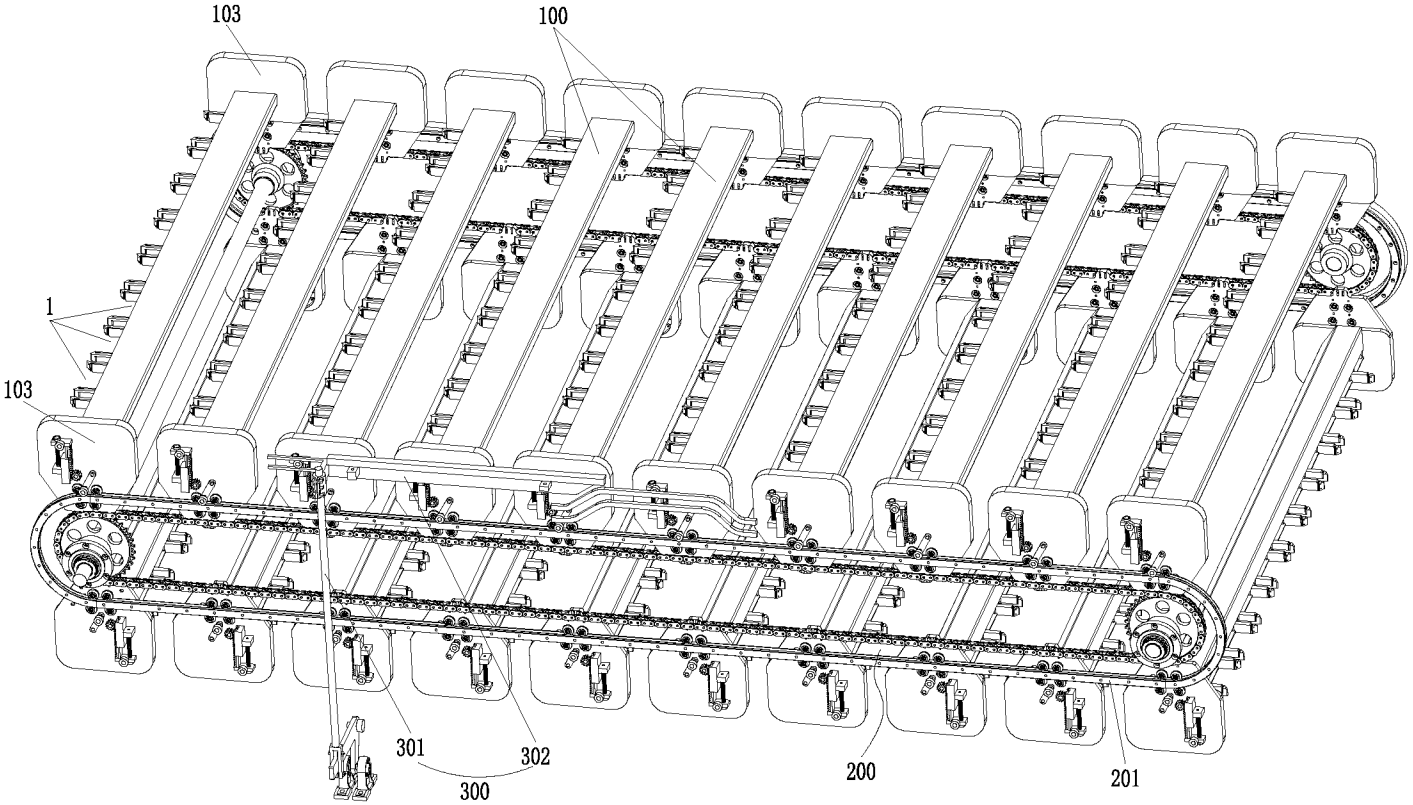
FIG. 2 is a schematic structural perspective view of FIG. 1.

As shown in FIGS. 1 and 2, a conveying device for a packing machine mainly includes a circulating conveyor mechanism 200 and a conveying module 100 for a packing machine. The conveying module 100 for the packing machine is arranged on the circulating conveyor mechanism 200 such that it is driven by the circulating conveyor mechanism 200 to travel along the circular loop of the circulating conveyor mechanism 200. The conveying module 100 for the packing machine includes a modular pedestal 101, and at least two holding units 1 are arranged in parallel on the modular pedestal 101 to hold packing bags. The number of the holding units 1 may be determined according to the actual needs. As for the multi-station packing machine in the prior art, its stations are arranged in a direction of conveying path of the circulating conveyor mechanism, and some of the stations are in a group. The offline mechanism used for the packaging processing operations includes a plurality of mechanism units arranged along the conveying direction of the circulating conveyor mechanism, and such a structure is actually a series structure. The more the number of parallel stations is, the longer the length of conveying path of the circulating conveyor mechanism is, which will significantly increase the space occupied by the packaging machine. The phase "holding units 1 are arranged in parallel" in this embodiment means that the holding units 1 are arranged in parallel relative to the circulating conveyor mechanism 200, It can be understood that the holding units 1 in the conveying module 100 for the packing machine are arranged in a direction perpendicular to the conveying path of the circulating conveyor mechanism 200. Thus, the conveying module 100 for the packing machine as a whole occupies only a single station on the conveying path of the circulation conveying mechanism 200. That is, regardless of whether the number of holding units 1 in the conveying module 100 for the packing machine increases or decreases, the conveying module 100 for the packing machine occupies only a single station. Therefore, the increase or decrease in the number of holding units 1 in the conveying module 100 for the packing machine does not affect the length of the conveying path of the circulating conveyor mechanism 200. The packaging production efficiency can be improved without excessively increasing the occupied space, and the structure is compact.

In an embodiment, as shown in FIGS. 1 to 5, the holding unit 1 includes a left holding component 11 and a right holding component 12 for being engaged with the sides of a packing bag. For example, the left holding component 11 is engaged with the left side of the packing bag, and the right holding component 12 is engaged with the right side of the packing bag, thereby fixing the packing bag on the conveying module 100 for the packing machine. In this way, the packing bag is in a controlled state, ensuring reliability of the packaging processing operations. Further, the left and right holding components 11, 12 are movable relative to each other. Generally, the packing bags are placed in a stacked state in a bag compartment, and may be taken out one by one from the bag compartment and then loaded on the holding units 1. Both sides of each packing bag may be engaged with the left and right holding components 11, 12 respectively, and the packing bag is generally in a flat state at this moment. Subsequently, it needs to perform packing processing such as opening, filling, sealing the packing bag. The mouth of the packing bag shall be opened during bag opening and filling operations, and the distance between two sides of the packing bag shall be decreased. The mouth of the packing bag shall be pulled to be in a flat state during sealing operation, so as to ensure flatness and sealing of the seal. Therefore, the packing bag placed on the holding unit 1 shall be in different states for different packaging processing operations. Since the left and right holding components 11, 12 are movable relative to each other, the spacing distance between the left and right holding components 11, 12 may be adjusted by moving the left and right holding components 11, 12 relative to each other, thereby adjusting the distance between two sides of the held packing bag. That is, the packing bag is switched between a straightened state and a loosened state to meet the requirements of various packaging processing operations. A telescopic linkage mechanism may be provided on the modular pedestal 101, and a telescopic drive mechanism is provided beside the circulating conveyor mechanism 200 to drive operation of the telescopic linkage mechanism. The telescopic linkage mechanism drives all of the holding units 1 to be switched synchronously between a bag deployed attitude and a bag retracted attitude. The spacing distance between the left and right holding components 11, 12 of the holding unit 1 in the bag deployed attitude is larger than that in the bag retracted attitude. The term "spacing distance between the left and right holding components 11, 12" stated herein refers to a distance from an engaging portion of the left holding component 11 with the left side of the packing bag to an engaging portion of the right holding component 12 with the right side of the packing bag. In an embodiment, the spacing distance between the left and right holding components 11, 12 of each holding unit 1 in the bag deployed attitude is defined as a bag deploy distance, and the spacing distance between the left and right holding components 11, 12 of each holding unit 1 in the bag retracted attitude is defined as a bag retracted distance smaller than bag deploy distance. The telescopic linkage mechanism is configured to cause a small change in the spacing distance between the left and right holding components 11, 12 so as to switch the packing bag between the straightened state and the loosened state. The linkage structure is adopted in this embodiment, which facilitates simplifying the telescopic drive mechanism. Only a single telescopic drive mechanism is required to drive all of the holding units 1 to switch the attitudes via the telescopic linkage mechanism, improving the consistency of the action, ensuring the stability of the various packaging processing operations and the quality of the processing, and having a contact structure to facilitate reduction of the equipment volume.

The telescopic linkage mechanism includes telescopic linkage bars 2 and a telescopic control member. The telescopic linkage bars 2 extend and are arranged in a direction of arrangement of the holding units 1, and are associated with at least one of the left and right holding components 11, 12. The term "associated" refers to connection including direct connection, indirect connection, drive connection, etc. The telescopic control member is drivingly connected to the telescopic linkage bar 2, and cooperated with the telescopic drive mechanism 300. The telescopic control member is driven by the telescopic drive mechanism 300, and then drives the telescopic linkage bar 2 to rotate around its own axis or move in its own axial direction, so as to adjust the spacing distance between the left and right holding components 11, 12 and ultimately switch the packing bag between the straightened state and the loosened state.

Figure 3:
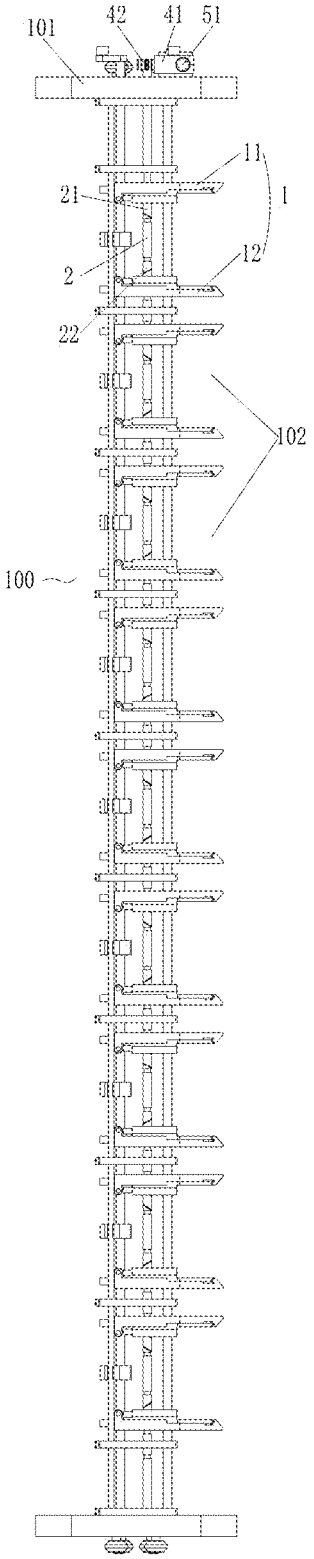
FIG. 3 is a schematic structural top view of a conveying module for a packing machine.
Figure 4:
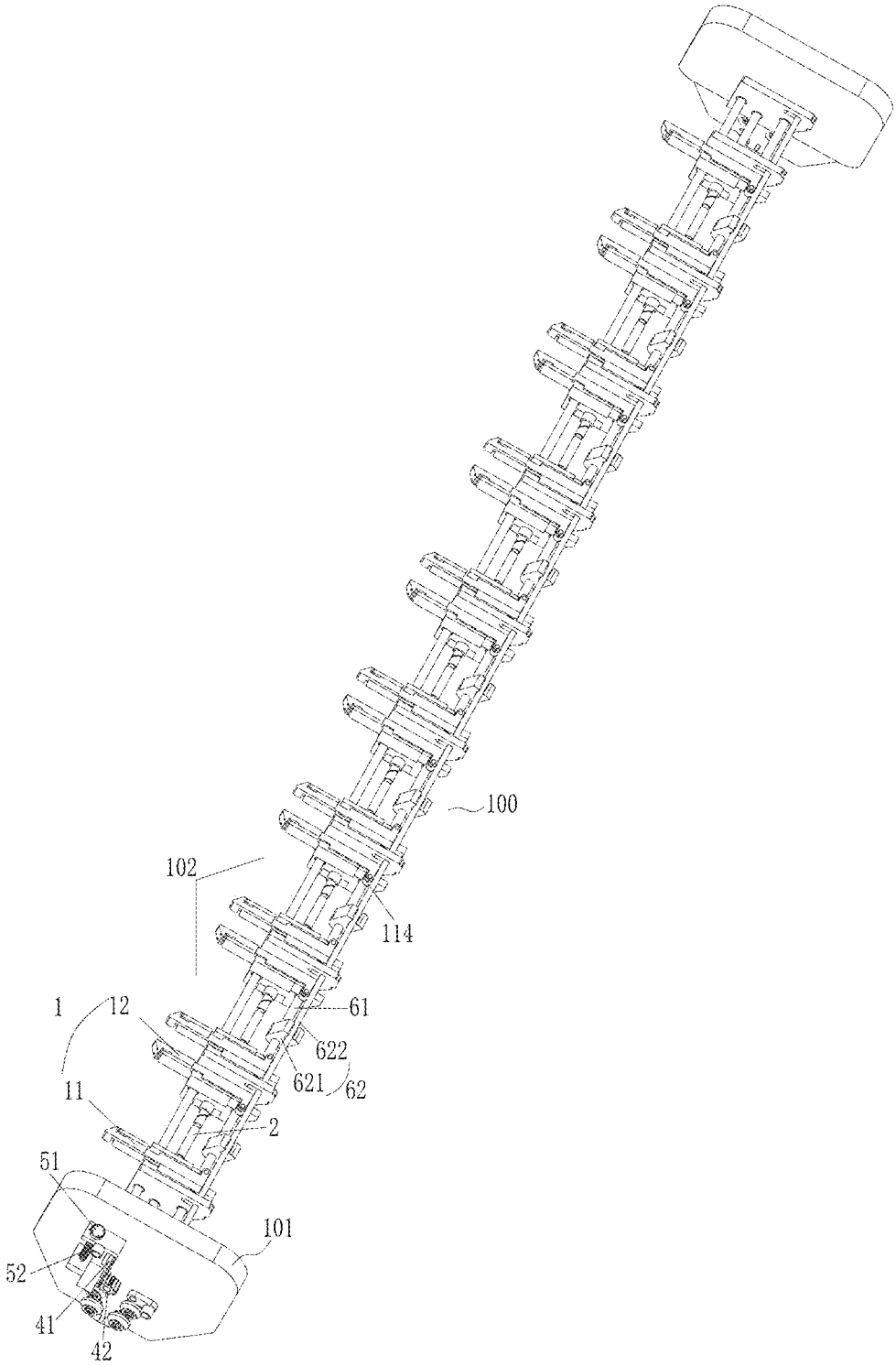
FIG. 4 is a schematic structural perspective view of the conveying module for the packing machine as shown in FIG. 3.
Figure 5:
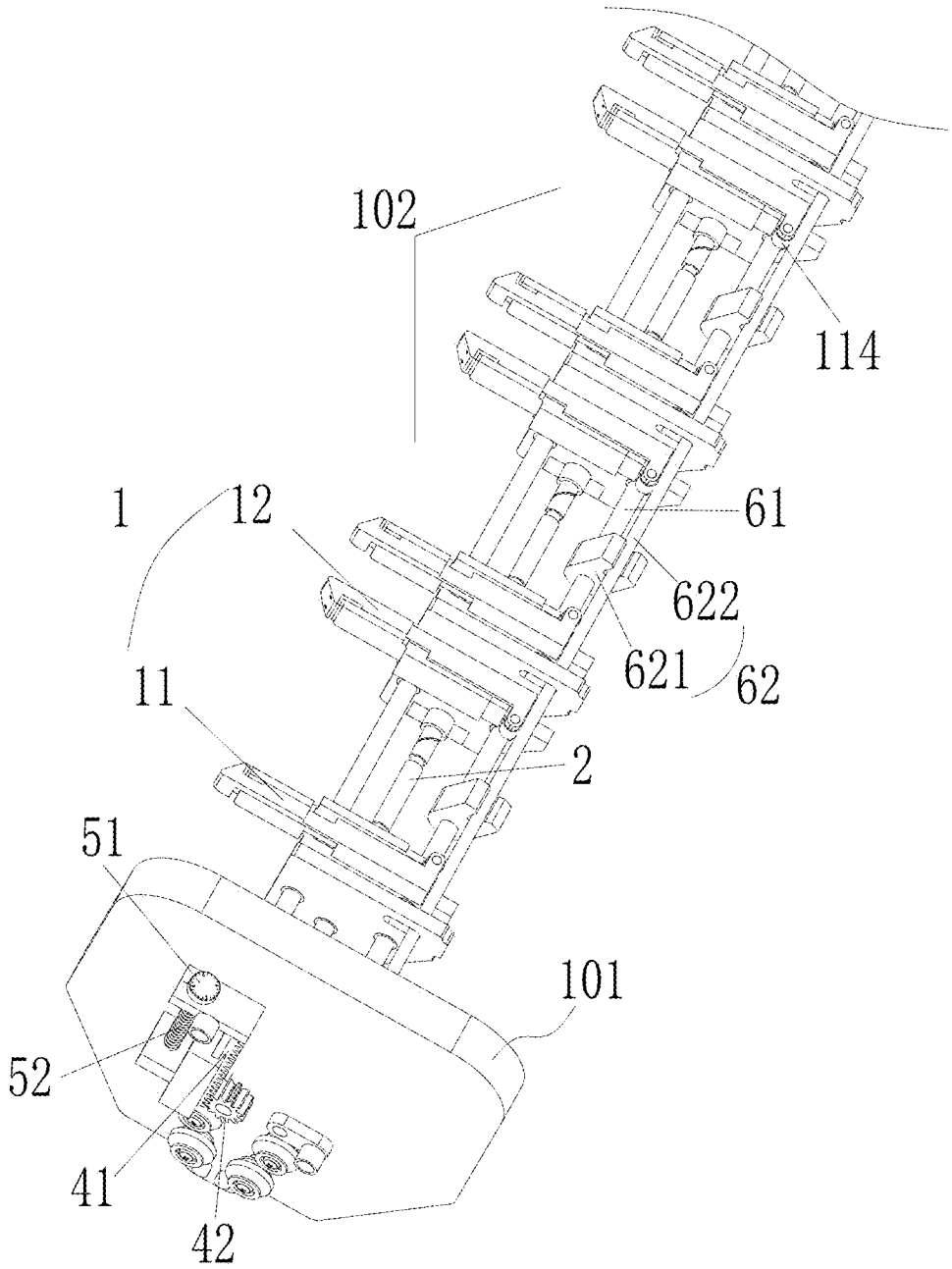
FIG. 5 is a schematic structural view of a part of FIG. 4.

In an embodiment as shown in FIGS. 3 to 5, the left and right holding components 11, 12 are slidably adjustable in the direction of arrangement of the holding units 1. The telescopic linkage bar 2 is an elongated bar extending in the direction of arrangement of the holding units 1, and is rotatably connected to the modular pedestal 101 of the conveying module 100 for the packing machine. The telescopic linkage bar 2 is provided with a first threaded section 21 and a second threaded section 22 which are oppositely threaded. The left holding component 11 is mounted on the first threaded section 21, and the right holding component 12 is mounted on the second threaded section 22. The left holding component 11 and the first threaded section 21 cooperates to form a structure of a lead screw-nut pair, and the right holding component 12 and the second threaded section 22 cooperates to form a structure of a lead screw-nut pair. Multiple holding units 1 are arranged in parallel, and the first and second threaded sections 21, 22 are provided in multiple groups being in one-to-one correspondence to the holding units 1. The telescopic linkage bar 2 rotates around its axis to move the left and right holding components 11, 12 in opposite axial directions of the telescopic linkage bar 2 so as to adjust the spacing distance. To ensure reliable movement of the left and right holding components 11, 12 when the telescopic linkage bar 2 rotates, a guide bar is provided in parallel to the telescopic linkage bar 2, and the left and right holding components 11, 12 are slidably connected to the guide bar. The guide bar may guide and limit the position of the left and right holding components 11, 12. Thus, it is possible to ensure precise axial movement of the left and right holding components 11, 12 as the telescopic linkage bar 2 rotates.

Further, the telescopic control member includes a telescopic control rack 41 and a telescopic control gear 42. The telescopic control rack 41 is slidably arranged on the modular pedestal 101 of the conveying module 100 for the packing machine, and the telescopic control gear 42 is rotatably arranged on the modular pedestal 101. The telescopic control rack 41 is meshingly engaged with the telescopic control gear 42, and cooperates with and driven by the telescopic drive mechanism 300. The telescopic control gear 42 is drivingly connected to the telescopic linkage bar 2 and drives the telescopic linkage bar 2 to rotate around its axis. In an embodiment, the telescopic control gear 42 is directly connected to the telescopic linkage bar 2, with the rotation axial direction of the telescopic control gear 42 being the axial direction of the telescopic linkage bar 2, and the sliding direction of the telescopic control rack 41 being perpendicular to the axial direction of the telescopic linkage bar 2. Preferably, the sliding direction of the telescopic control rack 41 is perpendicular to the conveying direction of the circulating conveyor mechanism 200, which facilitates arrangement of the telescopic drive mechanism. A control part is provided on the telescopic control rack 41 to cooperate with the telescopic drive mechanism which drives the telescopic control rack 41 to slide, which in turn drives the telescopic control gear 42 to rotate. As a result, the telescopic linkage bar 2 is rotated, so that the left and right holding components 11 and 12 move in opposite directions to adjust the spacing distance therebetween, i.e., switch the holding unit 1 between the bag deployed attitude and the bag retracted attitude. The structure is simple and easily achieved.

The cooperation between the telescopic drive mechanism and the telescopic linkage mechanism achieves switch between the bag deployed attitude and the bag retracted attitude of the holding unit 1. In other words, the cooperation between the telescopic drive mechanism and the telescopic linkage mechanism enables a small change of the spacing distance between the left and right holding components 11, 12, thereby only being suitable for the bag deploy action and bag retracted action of the packing bag of a single size. To widen the applicable scope of the packing machine which can be applied to the packing bag of various sizes, a bag width adjusting mechanism may be provided on the modular pedestal 101 of the conveying module 100 for the packing machine, and is associated with at least one of the left and right holding components 11, 12 to adjust synchronously the spacing distance between the left and right holding components 11, 12 of each holding unit 1 to match the packing bags of different sizes. The bag width adjusting mechanism is configured to adjust the spacing distance between the left and right holding components 11, 12 in a wide range to adapt to the packing bags of different sizes. The bag width adjusting mechanism does not hamper action of the telescopic linkage mechanism. That is, after the bag width adjustment of the bag width adjusting mechanism, the telescopic linkage mechanism still can adjust the spacing distance between the left and right holding components 11, 12 in a small range reliably and normally, thereby ensuring the stable and reliable packing processing while matching the packing bags of different sizes. For example, the original matching width of the packing bag is 10 cm, and the spacing distance between the left and right holding components is the bag deploy distance when it is 10 cm, and is the bag retracted distance when it is 8 cm. In other words, the telescopic linkage mechanism drives the left and right holding components to move with the spacing distance keeping in the range of 8 cm to 10 cm. When replacing with a packing bag with a width of 15 cm, the maximum spacing distance between the left and right holding components can only be 10 cm, and the packing bag with the width of 15 cm cannot be straightened, which seriously affects the packaging processing operations of bag loading and sealing. For the packing bag with the width of 15 cm, it is necessary to move the left and right holding components with the spacing distance in a range of 13 cm to 15 cm. Thus, the basic spacing distance between the left and right holding components needs to be adjusted, and then the telescopic linkage mechanism is used to drive the left and right holding components to switch attitudes.

In an embodiment as shown in FIGS. 4 and 5, the bag width adjusting mechanism is connected to the telescopic linkage mechanism, and is associated with at least one of the left and right holding components 11, 12 via the telescopic linkage mechanism. In other words, the bag width adjusting mechanism is configured to adjust the state of the telescopic linkage mechanism such as to indirectly adjust the spacing distance between the left and right holding components 11, 12 via the telescopic linkage mechanism. The bag width adjusting mechanism is appropriately combined with the telescopic linkage mechanism, such that the bag width adjusting mechanism is associated with at least one of the left and right holding components 11, 12 without providing excessive linkage mechanisms. The structure is more compact and concise, is conveniently implemented, and has a low cost. In an embodiment, the bag width adjusting mechanism includes a limiting member 51 and an elastic member 52. The limiting member 51 is adjustably connected to the modular pedestal 101 of the conveying module 100 for the packing machine in the sliding direction of the telescopic control rack 41. The elastic member 52 is arranged between the telescopic control rack 41 and the modular pedestal 101, and acts on the telescopic control rack 41 such that the telescopic control rack 41 elastically abuts against the limiting member 51. As such, the bag width adjusting mechanism is connected to the left and right holding components 11, 12 via the telescopic linkage mechanism. In this embodiment, the limiting member 51 is a screw, and threadedly connected to the modular pedestal 101. The limiting member 51 is screwed to easily perform adjustment. It is possible to adopt other structures other than this structure. For example, pin holes are provided in the modular pedestal 101 in the sliding direction of the telescopic control rack 41 at intervals, and the limiting member 51 is a limiting pin and is adjustably connected to the modular pedestal 101 by being inserted in the different pin hole. The telescopic control rack 41 is provided with an abutment portion provided with a through hole for the screw to pass through, and can be stopped by cap portion of the screw. The elastic member 52 is a spring provided on the rod portion of the screw. The structure is compact, has a good stability, and can ensure that the elastic member 52 stably applies an elastic force to the telescopic control rack 41. The telescopic control rack 41 can be driven to slide only by screwing the limiting member 51, so as to significantly adjust the spacing distance between the left and right holding components 11, 12 to adapt to the packing bags of different sizes. The bag width adjusting mechanism only limit the telescopic control rack 41 on a single side, and the telescopic control rack 41 still has an elastic moving space and can overcome the elastic member 52 to slide relative to the limiting member 51 in a direction away from the against the limiting member 51. In other words, after bag width adjustment, the telescopic drive mechanism can further drive the telescopic control rack 41 to move such that the spacing distance between the left and right holding components is adjusted slightly. That is, after matching the packing bags of different sizes, the bag deployed and retracted actions can be performed normally, meeting the requirements of the packaging processing and ensuring normal operation of the packaging processing.

Figure 6:
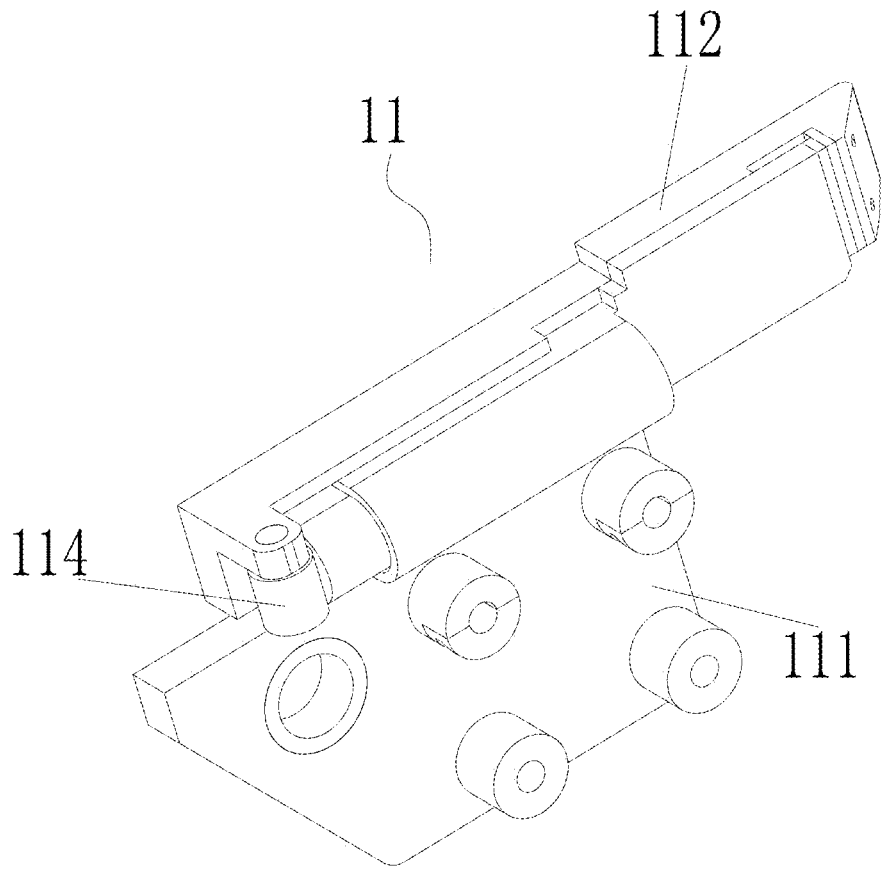
FIG. 6 is a schematic structural view of a left holding component.
Figure 7:
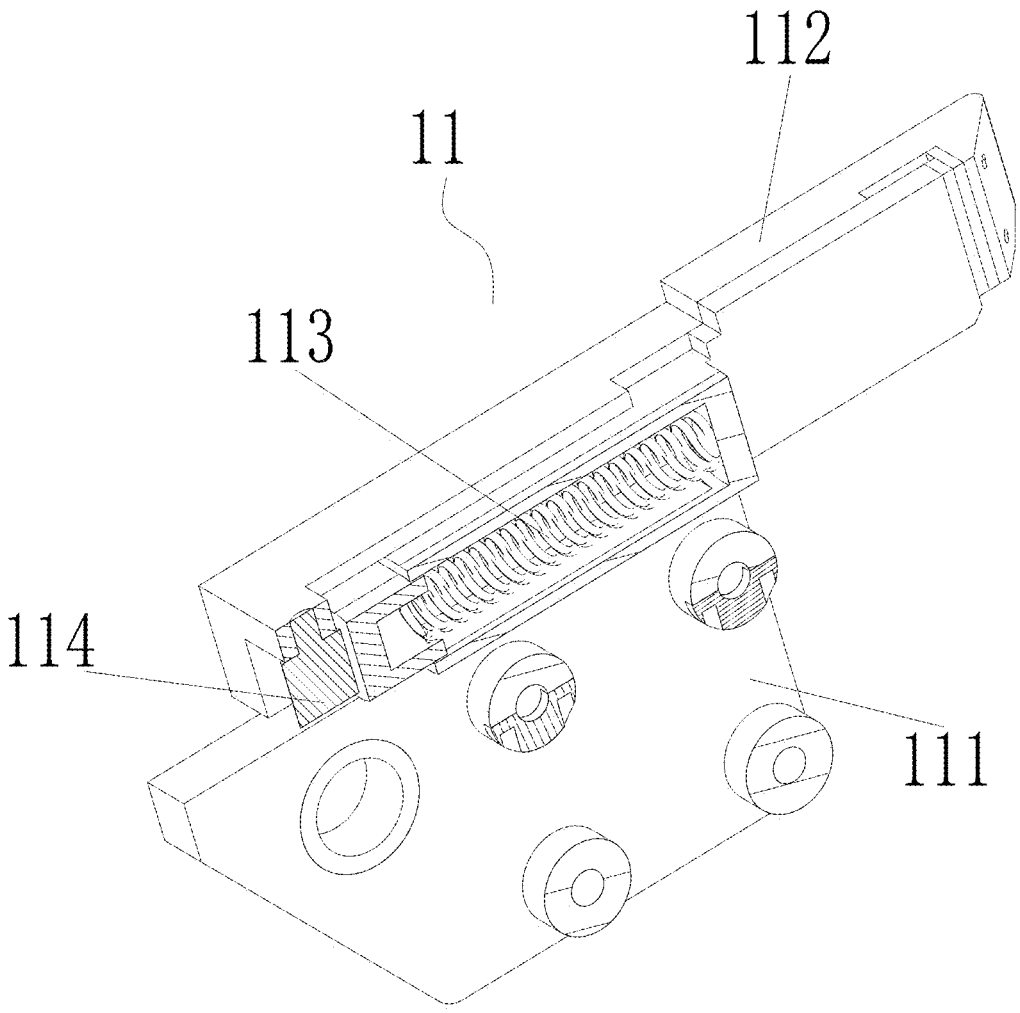
FIG. 7 is a schematic structural section view of the left holding component as shown in FIG. 6.

Further, the left and right holding components 11, 12 each may be a sucker or a jig, as long as the left and right holding components 11, 12 can be engaged stably with the sides of a packing bag respectively to keep the packing bag in a controlled state. The sucker sucks the side of the packing bag in a negative pressure adsorption way, whereas the jig clamps and fixes the side of the packing bag in a clamping way. For the sucker, grasping and releasing the packing bag are achieved by controlling on/off of the negative pressure. For the jig, grasping and releasing the packing bag are achieved by controlling opening/closing of the jig. In comparison, the jig structure is implemented more easily and has a lower cost. The jig is preferably an elastic jig, which can automatically and stably clamp and fix the packaging bag effectively. As shown in FIGS. 6 and 7, the left and right holding components 11, 12 in this embodiment are jigs, and the conveying module 100 for the packing machine is correspondingly provided with a clamping linkage mechanism which drives the left and right holding components 11, 12 of all the holding units 1 to synchronously switch between a jig opened state and a jig closed state. When a bag is loaded, the jig is firstly switched into the jig opened state to receive the incoming packing bag, and then switched into the jig closed state to stably clamp the packing bag. When unloading, the jig is switched into the jig opened state to release the packing bag which has been packed and processed. With the clamping linkage mechanism, the degree of integration is high, and the structure is compact with small footprint and is driven more easily since only a single drive mechanism is needed, reducing difficulty in designing the drive mechanism and the occupied volume and effectively ensuring consistency of action of the holding units.

As shown in FIGS. 4 and 5, the clamping linkage mechanism includes clamping linkage bars 61 extending and arranged in a direction of arrangement of the holding units 1. An actuating part 62 is provided on the clamping linkage bar 61 and is associated with the left and right holding components 11, 12. The clamping linkage bar 61 rotates around its axis or moves in an axial direction, which drives, via the actuating part 62, the left and right holding components 11, 12 to synchronously switch between the jig opened state and jig closed state. In an embodiment, the clamping linkage bar 61 is an elongated bar extending in the direction of arrangement of the holding units 1, and is rotatably connected to the modular pedestal 101. A cam rocker arm is provided at an end of the clamping linkage bar 61 and is configured to drive the clamping linkage bar 61 to rotate. The actuating part 62 includes a swing arm member 621 and an pushing rod 622. The swing arm member 621 is arranged on the clamping linkage bar 61 in such a manner as to rotate with the clamping linkage bar 61. The pushing rod 622 is an elongated bar extending in the direction of arrangement of the holding units 1, and slidably connected to the modular pedestal 101, with the sliding direction of the pushing rod 622 being perpendicular to the axial direction of the pushing rod 622. The swing arm member 621 are associated with the pushing rod 622. The swing arm member 621 is provided with a U-shaped groove or an elongated groove which is engaged with the pushing rod 622 to form a groove-pin pair. When rotating with the rotating clamping linkage bar 61, the swing arm member 621 pushes the pushing rod 622 to slide. The pushing rod 622 is associated with all the left and right holding components 11, 12, so the pushing rod 622 pushes all the left and right holding components 11, 12 when sliding, such that all the holding units 1 are synchronously switched to the jig opened state.

As shown in FIGS. 6 and 7, the left and right holding components 11, 12 each include a jig primary body 111, a jig secondary body 112 and a jig elastic member 113. The jig secondary body 112 is movably connected to the jig primary body 111, and the jig elastic member 113 is arranged between the jig primary body 111 and the jig secondary body 112, so as to clamp the packing bag between the jig primary body 111 and the jig secondary body 112. In an embodiment, the jig primary body 111 includes a cantilever portion, and the jig secondary body 112 is connected to the cantilever portion in a linearly slidable manner, which can effectively suspend and hold the packaging bag to avoid occurrence of interference. Further, a roller 114 is rotatably arranged on the jig secondary body 112, and is configured to cooperate with the clamping linkage mechanism to drive the jig secondary body 112 to move relative to the jig primary body 111. Since the left and right holding components 11, 12 are movable to adjust the spacing distance, there is a case that the left and right holding components 11, 12 moves relative to the clamping linkage mechanism. To ensure that the left and right holding components 11, 12 move smoothly without excessive resistance, the roller 114 is provided on the jig secondary body 112, and cooperatively contacts the pushing rod 622 of the clamping linkage mechanism. The roller 114 can roll relative to the pushing rod 622 in the length direction of the pushing rod 622, not only ensuring that the pushing rod 622 can push reliably the jig secondary body 112 via the roller 114, but also ensuring that the left and right holding components 11, 12 can slide smoothly to adjust the spacing distance. As shown in FIGS. 3 to 5, in this embodiment, at the side perpendicular to the direction of arrangement of the holding units 1, the conveying module 100 for the packing machine is provided with a receiving site 102 for placement of the packing bag, and each holding unit 1 suspends and holds the packing bag on the receiving site 102. Such a structure is not easy to cause interference, and facilitates the packaging processing operations of the loaded bag.

Figure 8:
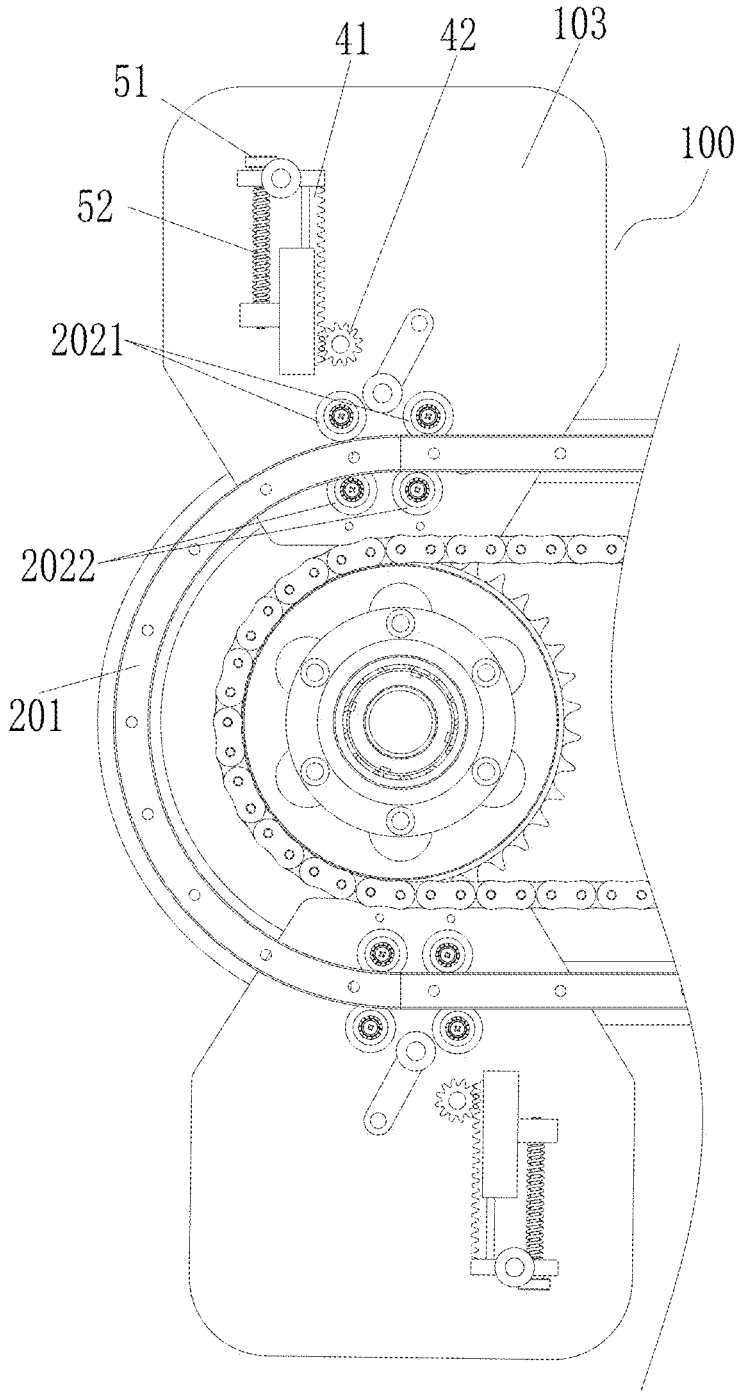
FIG. 8 is a schematic structural view showing engagement between a support plate and a guide rail of a conveying module for a packing machine.

Further, as shown in FIG. 2, the circulating conveyor mechanism 200 includes two guide rails 201 which are arranged in parallel and each in a circular path. The conveying module 100 for the packing machine is slidably connected to the guide rails 201. A conveying drive mechanism of the circulating conveyor mechanism 200 drives the conveying module 100 for the packing machine to travel along the guide rails 201 intermittently. In an embodiment, the length direction of the conveying module 100 for the packing machine is perpendicular to the conveying direction of the circulating conveyor mechanism 200, that is, the direction of arranging the holding units 1 in parallel on the conveying module 100 for the packing machine is perpendicular to the conveying direction of the circulating conveyor mechanism 200. Both ends of the conveying module 100 for the packing machine are slidably connected to the guide rails 201, respectively. In an embodiment, the modular pedestal 101 includes two support plates 103 spaced apart and slidably connected to the guide rails 201 respectively. The telescopic linkage mechanism and the holding units 1 arranged in parallel are disposed between the two support plates 103. Such a structure is simple and compact. The support plate 103 functions to carry the telescopic linkage mechanism, the holding units 1 and the like, and is slidably engaged with the guide rail 201. The holding units 1 are suspended between the two support plates 103, having a lightweight structure and a good stability. As shown in FIG. 8, the telescopic control member is provided on the support plate 103, which facilitates cooperation between the telescopic control member and the telescopic drive mechanism beside the circulating conveyor mechanism 200 to drive the telescopic linkage bar 2. In an embodiment, the telescopic control rack 41 and the telescopic control gear 42 are provided on the support plate 103. The telescopic control rack 41 is slidably connected to the support plate 103, and the telescopic control gear 42 is rotatably connected to the support plate 103. Similarly, the limiting member 51 of the bag width adjusting mechanism is adjustably connected to the support plate 103, and the elastic member 52 is provided between the support plate 103 and the telescopic control rack 41 so that the telescopic control rack 41 elastically abuts against the limiting member 51.

Further, the support plate 1033 is provided with a sliding part engaged with the guide rail 201. The sliding part includes a first guide wheel 2021 and a second guide wheel 2022 between which the guide rail 201 is sandwiched. The guide rail 201 is provided with a guide groove on each side, and the first and second guide wheels 2021, 2022 are slidably received in the guide grooves, so as to ensure the precise and stable traveling of the conveying module 100 for the packing machine. Further, there are two first guide wheels 2021 spaced apart in the direction of path of the guide rail 201, and two second guide wheels 2022 spaced apart in the direction of path of the guide rail 201. The path of the guide rail 201 is oblong as a whole, that is, the guide rail 201 includes arc sections and straight sections. The first and second guide wheels 2021, 2022 are in rolling contact with the guide rail 201 when the sliding part is located at the arc sections and the straight sections of the guide rail 201. When the conveying module 100 for the packing machine travels to the arc section, the sliding part of the support plate 103 is engaged with the arc section of the guide rail 201, and the first and second guide wheels 2021, 2022 are in rolling contact with the arc section, ensuring the stability and smoothness when passing through the bending section. The plane where the conveying path of the circulating conveyor mechanism 200 is located is vertically oriented. The two straight sections of the guide rail 201 are parallel to the horizontal plane and are distributed in the up and down direction, and the ends of the two straight sections are connected through the respective arc sections. The conveying drive mechanism of the circulating conveyor mechanism 200 may be a chain drive mechanism, a synchronous belt drive mechanism, a magnetic levitation drive mechanism and so on.

Figure 9:
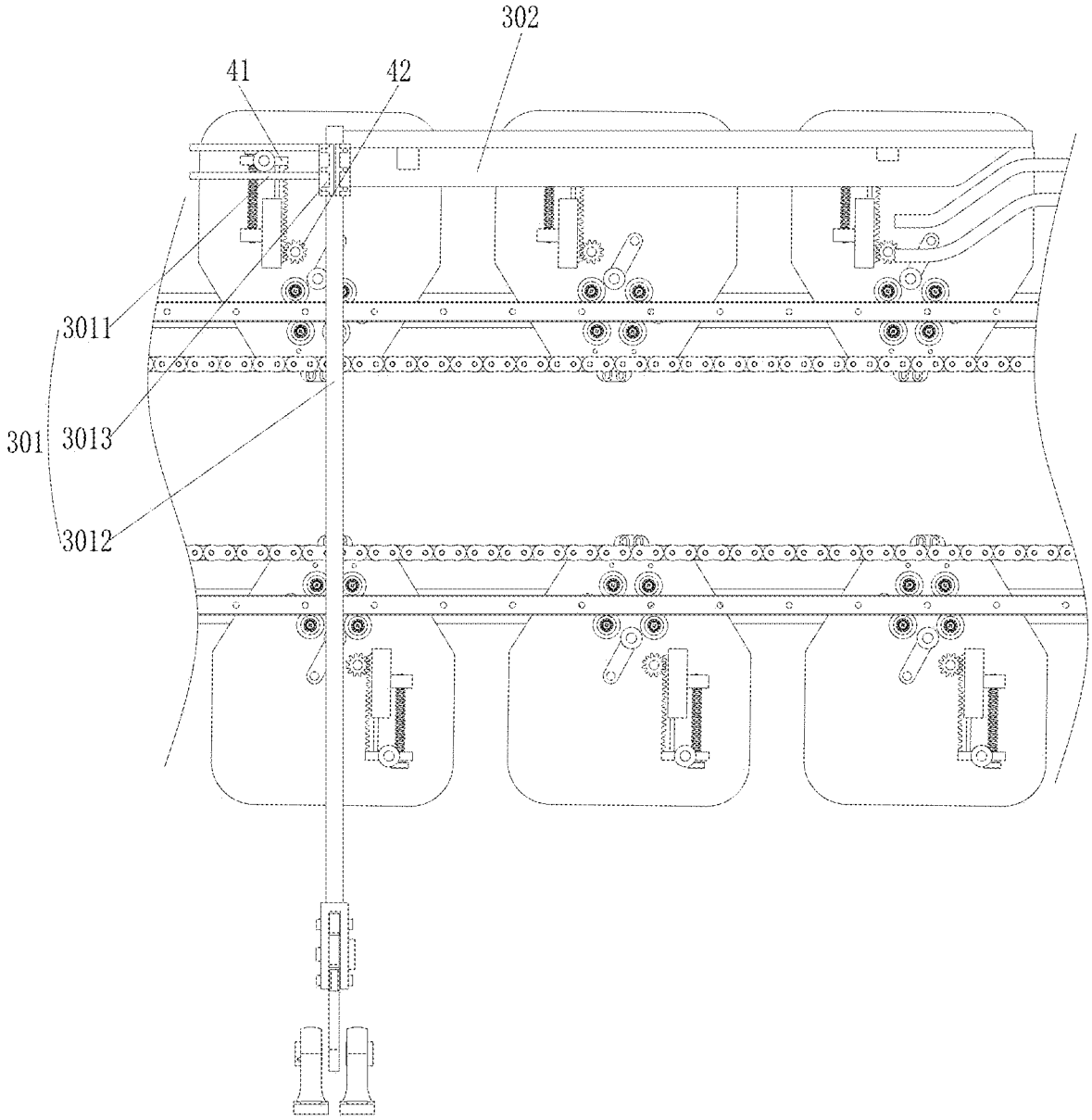
FIG. 9 is a schematic structural view of a telescopic drive mechanism.

Further, as shown in FIGS. 1, 2 and 9, the telescopic drive mechanism includes a power actuating mechanism 301, or a guiding member 302 provided along the conveying path of the circulating conveyor mechanism 200, or combination thereof. The power actuating mechanism 301 refers to a mechanism capable of carrying out an action, which may be driven by a motor, cylinder, etc. As shown in FIG. 2, the power actuating mechanism 301 is an action mechanism capable of carrying out a linear reciprocating movement, and moves in the sliding direction of the telescopic control rack 41. In an embodiment, the power actuating mechanism 301 includes a toggle member 3011 and a power assembly 3012 connected to and driving the toggle member 3011. The toggle member 3011 includes two toggle levers spaced apart and parallel to the conveying direction of the circulating conveyor mechanism 200. When the conveying module 100 for the packing machine moves to a position where the power actuating mechanism 301 is located, the control part on the telescopic control rack 41 enters into the toggle member 3011 of the power actuating mechanism 301, and the power assembly 3012 drives, via the toggle member 3011, the telescopic control rack 41 to move, thereby driving the holding units 1 to switch from the bag deployed attitude to the bag retracted attitude. The power actuating mechanism 301 may be an active telescopic drive mechanism which actively drives the telescopic linkage mechanism as needed. As shown in FIGS. 2 and 9, the guiding member 302 is a guide groove, a guide rail or the like. The conveying module 100 for the packing machine moves under drive of the circulating conveyor mechanism 200. By designing the path, shape or structure of the guiding member 302, the telescopic linkage mechanism may be automatically driven to move during movement of the conveying module 100 for the packing machine. For example, the path of the guiding member 302 is curved, folded or changed in any other way such as to drive the telescopic linkage mechanism to move.

For the packing machine, in the packaging processing operation of filling material, it is necessary to maintain the holding units 1 in the bag retracted attitude. In order to improve the production efficiency and optimize the static and dynamic ratio of the packaging machine, when there is more material to be filled and it takes a long time, the operation of filling material will be divided into multiple steps so that the conveying path covered by the material filling operation is long in length, and the guiding member 302 is more suitable for such an application. The telescopic drive mechanism may adopt one of the power actuating mechanism 301 and the guiding member 302, or combination of them, depending on the specific situation. When the power actuating mechanism 301 is combined with the guiding member 302, the power actuating mechanism 301 firstly drives the telescopic control member of the telescopic linkage mechanism to move, and then directs the telescopic control member into the guiding member 302, so that the telescopic control member of the telescopic linkage mechanism is guided and limited by the guiding member 302 in a long conveying path, and so that the holding units 1 is maintained in a desired attitude.

When the bag width adjusting mechanism is associated with at least one of the left and right holding components 11, 12 via the telescopic linkage mechanism, the bag width adjusting mechanism adjusts the state of the telescopic linkage mechanism, and then indirectly adjusts, via the telescopic linkage mechanism, the spacing distance between the left and right holding components 11, 12 to adapt to the packing bags of different sizes. After the bag width adjusting mechanism adjusts the state of the telescopic linkage mechanism to adapt to the packing bags of different sizes, the original position of the telescopic control member of the telescopic linkage mechanism is changed. It is necessary to adaptively adjust the telescopic drive mechanism to adapt to the telescopic control member in the new position, thereby matching the packing bags of different sizes while achieving normal telescopic adjustment. The toggle member 3011 is adjustably connected to and driven by the power assembly 3012. The position of the toggle member 3011 is adjusted to adapt to the positional change of the telescopic control member. In an embodiment, the toggle member 3011 includes hoop part 3013, and the power assembly 3012 includes a tie rod. The hoop part 3013 is adjustable connected to and surrounds the tie rod, which facilitates assembling or disassembling, a stable connection and a convenient adjustment. The height of the toggle member 3011 on the tie rod may be adjusted to precisely adapt to the positional change of the telescopic control member. For the guiding member 302, it may be adjustably disposed next to the circulating conveyor mechanism 200. The conveying device for the packing machine may be provided with a side plate (no shown) at the side of the circulating conveyor mechanism 200, and the side plate is configured to protect the interior components of the conveying device for the packing machine and also to ensure the aesthetics. The guiding member 302 may be adjustably mounted on the side plate. After bag width adjustment, it is convenient to adjust the height of the guiding member 302 to precisely adapt to the change of position of the telescopic control member. For the power actuating mechanism 301, the toggle member 3011 moves under drive of the power assembly 3012, so that the power assembly 3012 may directly adjust the moving range of the toggle member 3011 to adapt to the positional change of the telescopic control member after the bag width adjustment.

Figure 10:
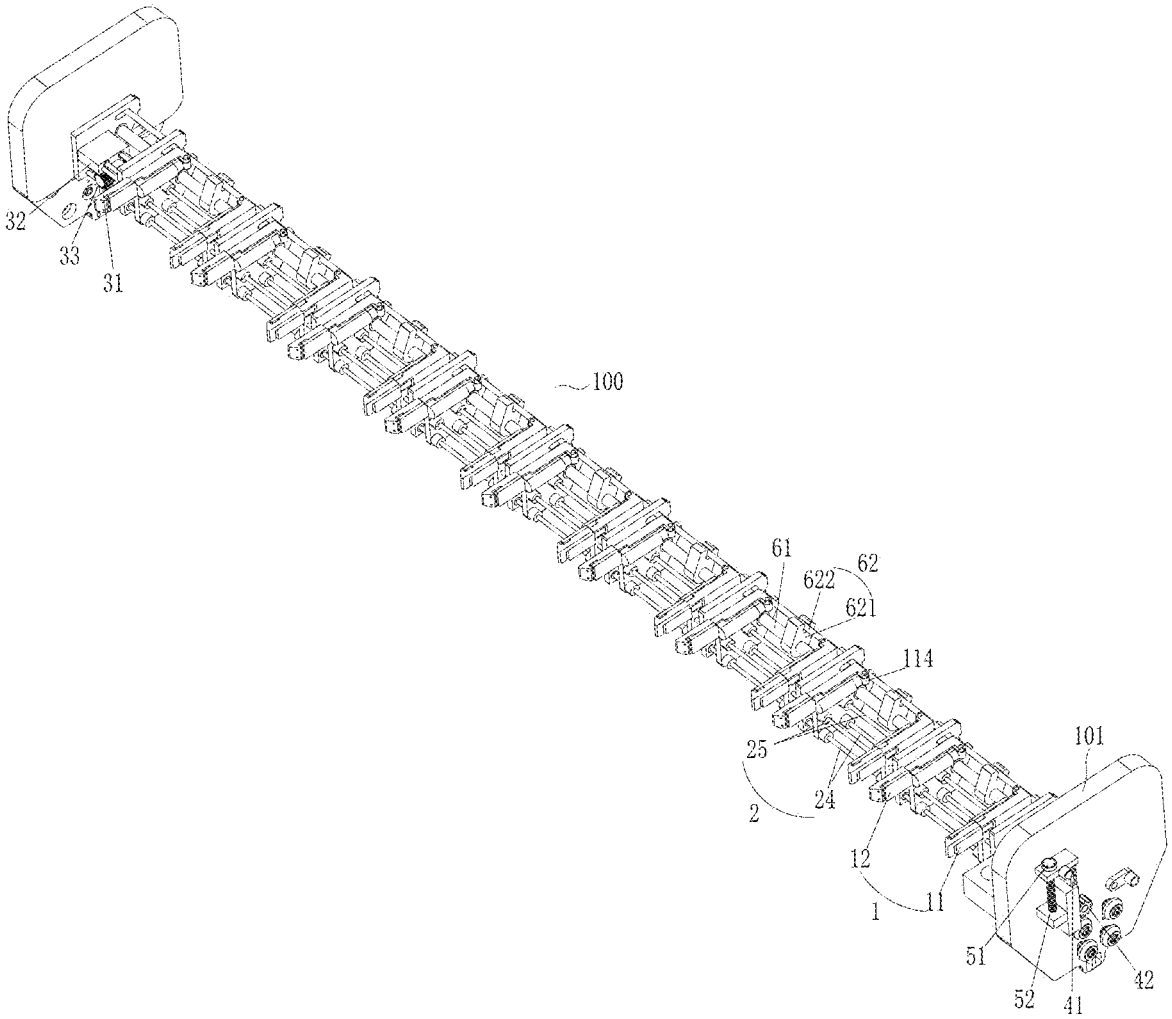
FIG. 10 is a schematic structural view of another conveying module for a packing machine.
Figure 11:
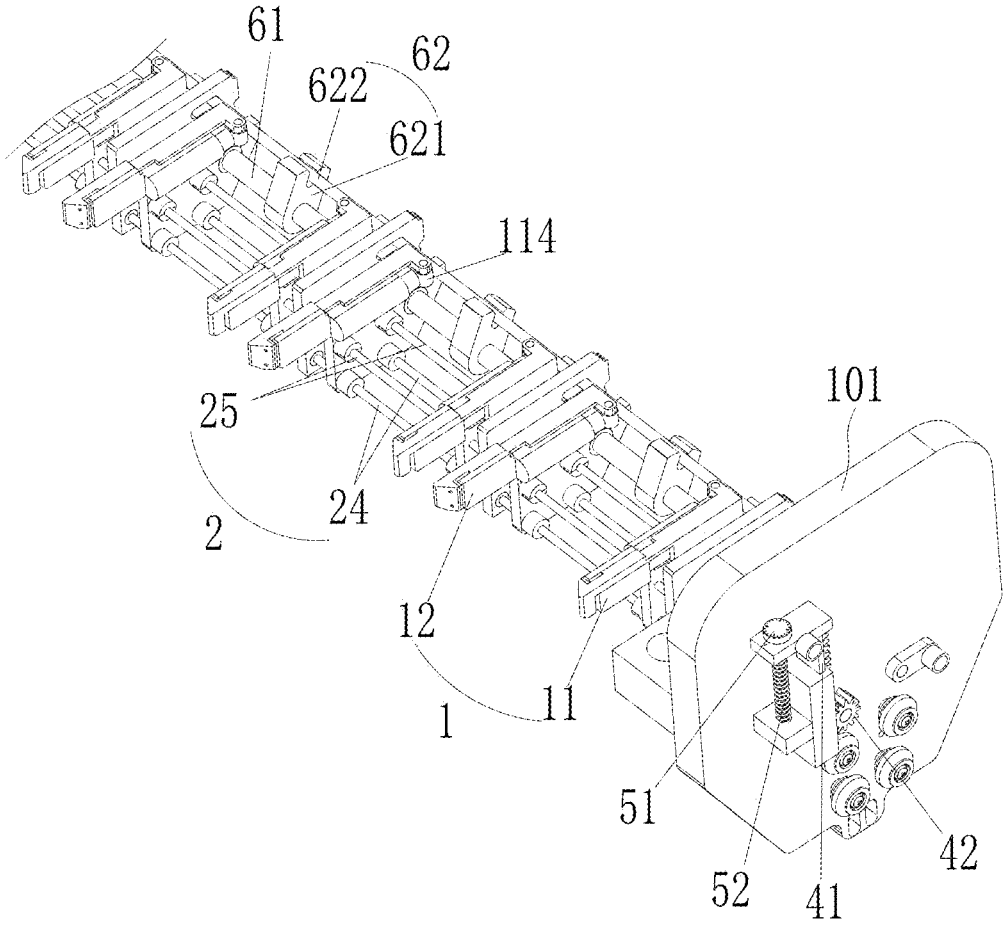
FIG. 11 is a schematic structural view of a part of FIG. 10.
Figure 12:
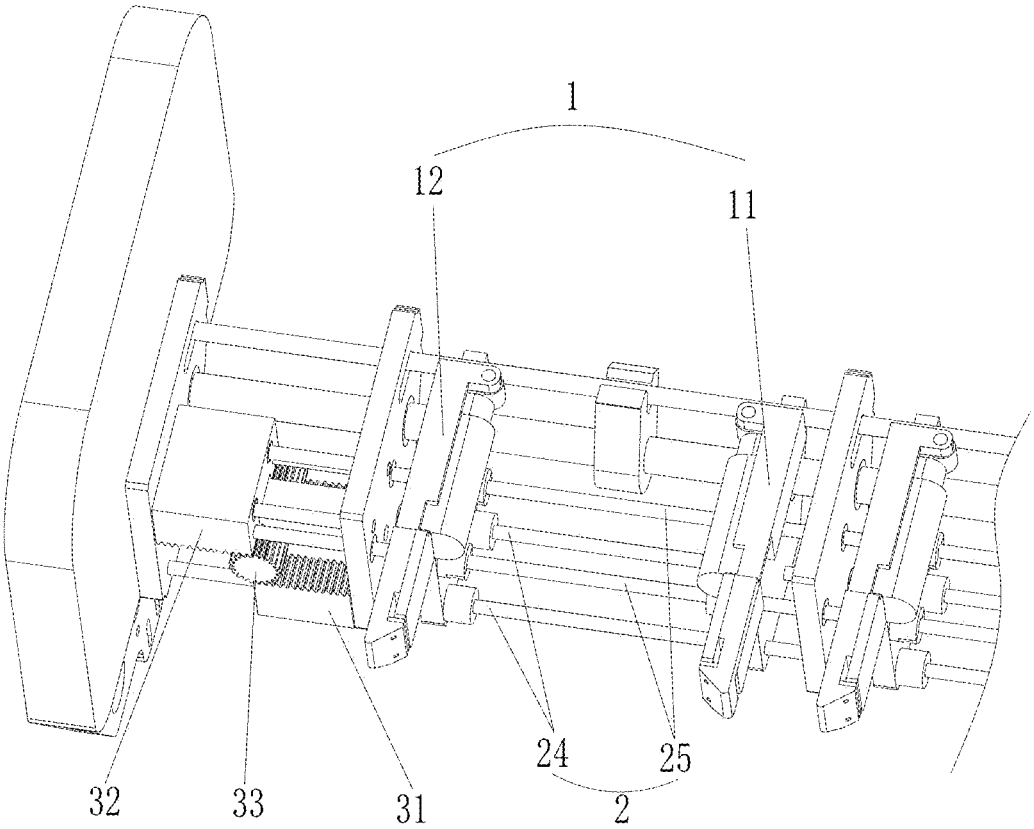
FIG. 12 is a schematic structural view of a reverse linkage mechanism of the conveying module for the packing machine as shown in FIG. 10.

In an embodiment as shown in FIGS. 10 to 12, the left and right holding components 11, 12 are both slidably adjustable in the arrangement direction of the holding units 1. The telescopic linkage bar 2 includes a first linkage bar 24 and a second linkage bar 25 parallel to each other. The first linkage bar 24 is connected to the left holding component 11, and the second linkage bar 25 is connected to the right holding component 12. The left holding component 11 is slidably cooperated with the second linkage bar 25, and the right holding component 12 is slidably cooperated with the first linkage bar 24. The first linkage bar 24 and the second linkage bar 25 move in opposite axial directions to adjust the spacing distance between the left and right holding components 11, 12. In an embodiment, the first and second linkage bars 24, 25 each are an elongated bar extending in the direction of arrangement of the holding units 1. The first linkage bar 24 includes two bars parallel to each other, and the second linkage bar 25 also includes two bars parallel to each other, which effectively improves the stability of the structure and ensures stability and precision of adjustment of the spacing distance between the left and right holding components 11, 12. In this embodiment, the first and second linkage bars 24, 25 are connected by a reverse linkage mechanism such that, when one of the first and second linkage bars 24, 25 moves in the axial direction, the reverse linkage mechanism drives the other of the first and second linkage bars 24, 25 to axially move in a reverse direction. In an embodiment, the reverse linkage mechanism includes a first rack 31 connected to the first linkage bar 24, a second rack 32 connected to the second linkage bar 25, and a first gear 33. The first and second racks 31, 32 have a length direction being along the axial direction of the first and second linkage bars 24, 25, and are spaced apart in parallel. The first gear 33 is arranged between and meshed with first and second racks 31, 32. As such, when one of the first and second linkage bars is driven to move axially, the reverse linkage mechanism drives the other of the first and second linkage bars to move axially in the reverse direction, so as to adjust the spacing distance between the left and right holding components 11, 12, which is conducive to simplifying the telescopic drive mechanism, reducing the difficulty of the design, and improving the compactness of the structure. Further, the present embodiment also adopts the combination of the telescopic control rack 41 and the telescopic control gear 42 to form the telescopic control member. Since the first and second linkage bars 24, 25 are axially movable, the telescopic control gear 42 and the telescopic linkage bars are drivingly connected via a transmission mechanism such as to drive the telescopic linkage bars to move in their axial directions. In an embodiment, the telescopic control gear 42 is drivingly connected to the first linkage bar 24 through a lead screw-nut pair. That is, the telescopic control gear 42 is connected to a lead screw of the lead screw-nut pair so as to drive the lead screw to rotate, whereas the first linkage bar 24 is connected to a nut of the lead screw-nut pair. The lead screw-nut pair converts the rotating motion of the telescopic control gear 42 into the axial linear motion of the first linkage bar 24, so as to adjust the spacing distance between the left and right holding components 11, 12 to switch between the bag deployed attitude and the bag retracted attitude.

Figure 13:
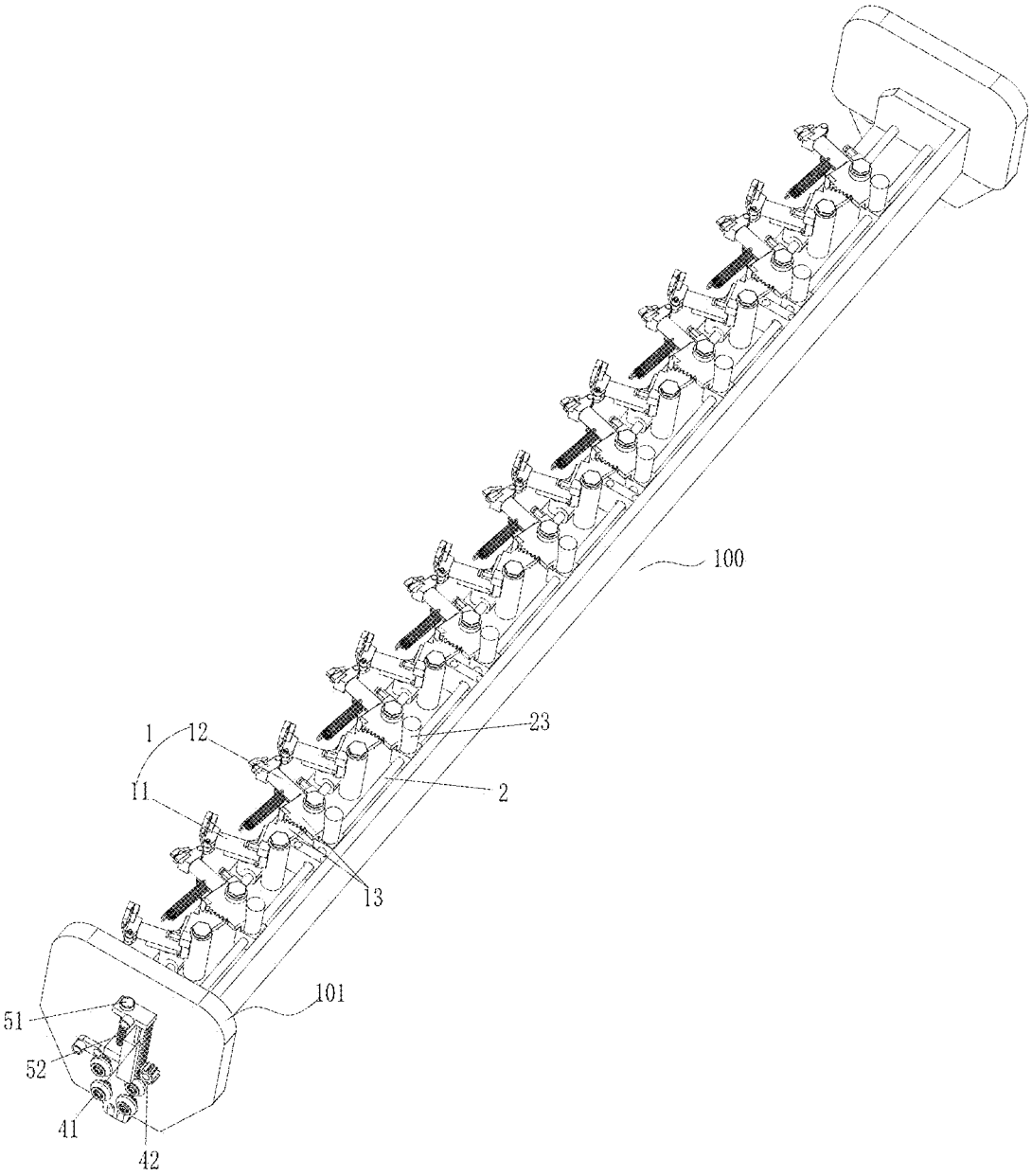
FIG. 13 is a schematic structural view of another conveying module for a packing machine.
Figure 14:
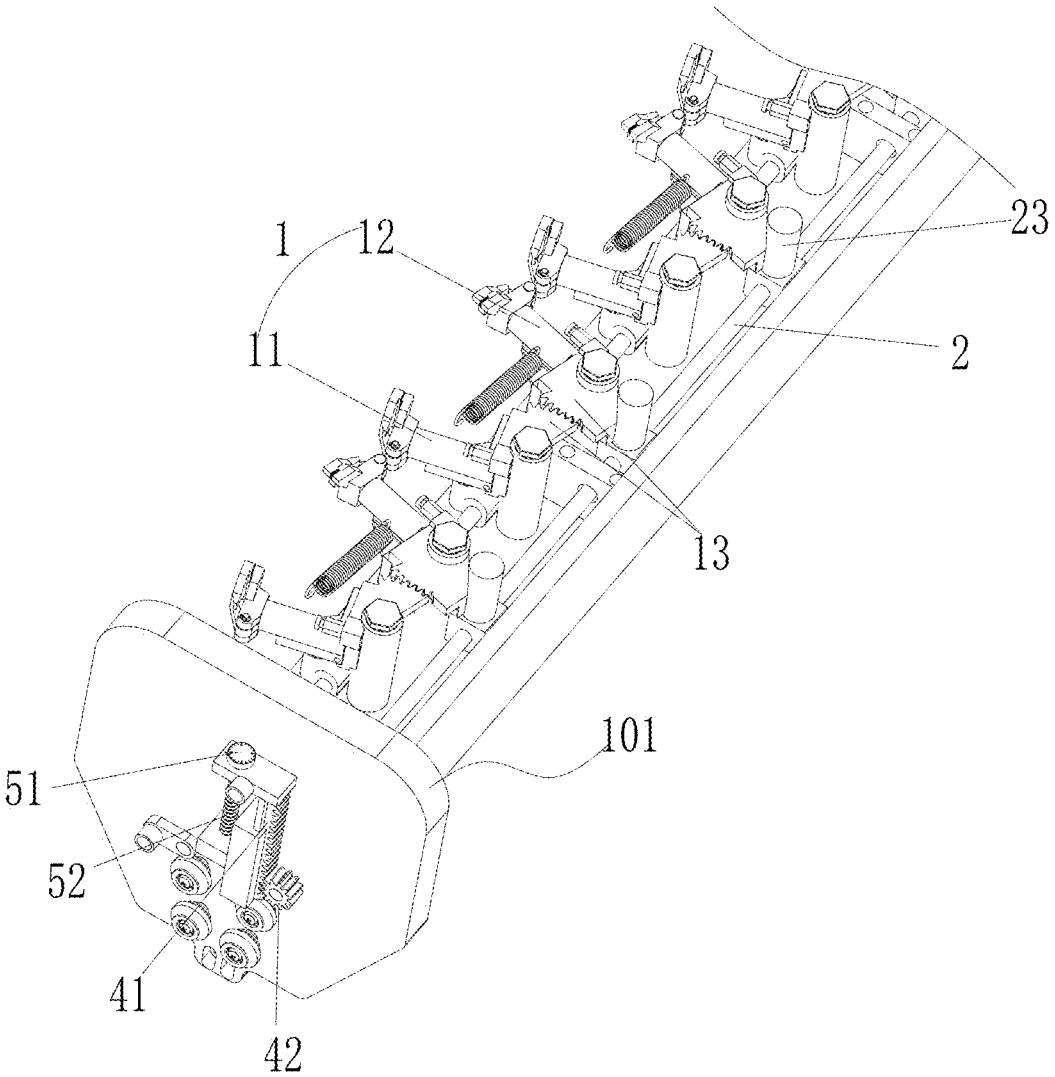
FIG. 14 is a schematic structural view of a part of FIG. 13.
Figure 15:
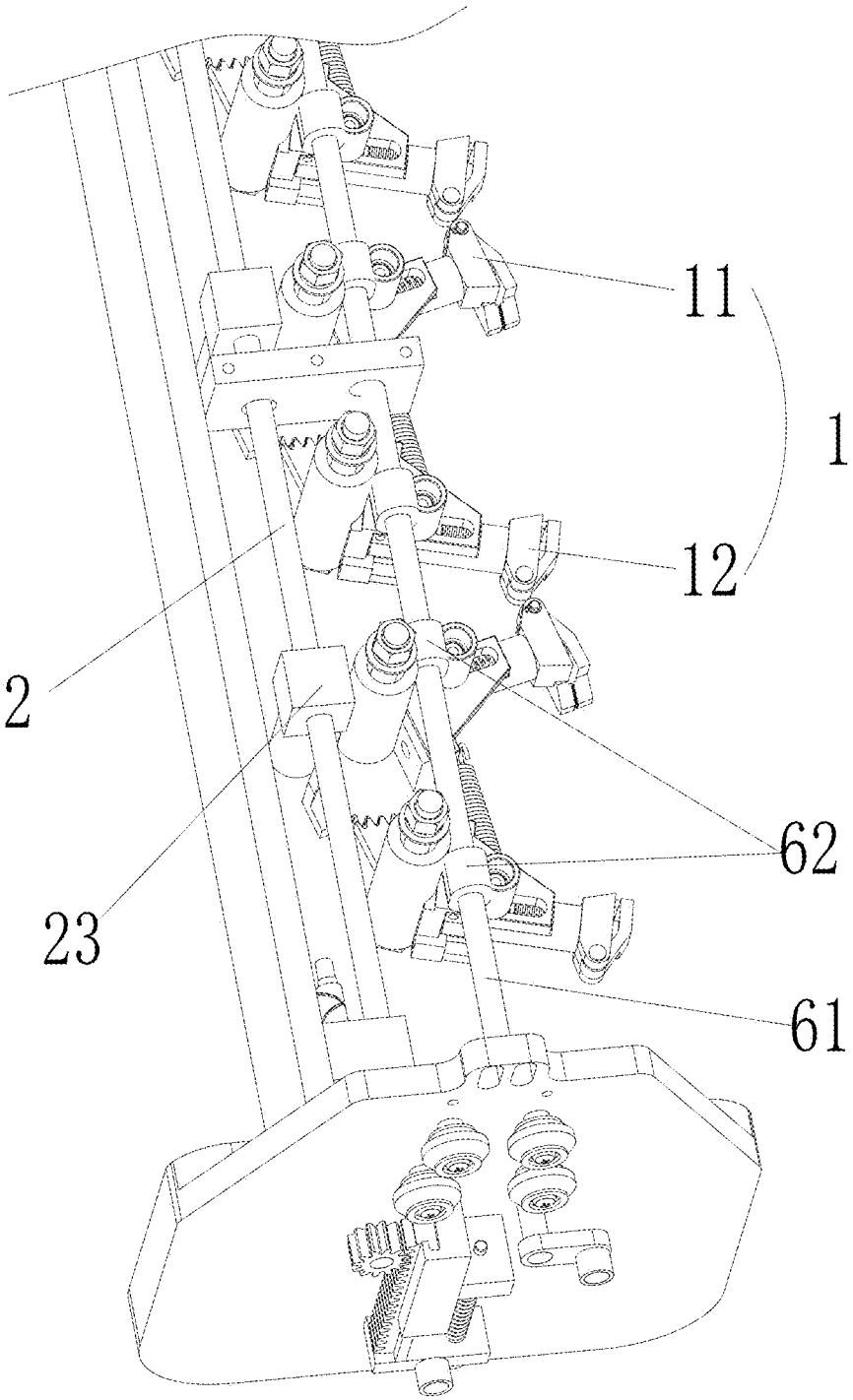
FIG. 15 is a schematic structural view of bottom of the part of FIG. 13.

In an embodiment as shown in FIGS. 13 to 15, the left and right holding components 11, 12 each are rotatably arranged on the modular pedestal 101 of the conveying module 100 for the packing machine, and each are provided with a gear part 13 so that they are meshingly connected with each other. In this embodiment, the spacing distance between the left and right holding components 11, 12 may be adjusted in a swinging manner to switch the holding units 1 between the bag deployed attitude and the bag retracted attitude. The term "the spacing distance between the left and right holding components 11, 12" described herein refers to a distance from an engaging portion of the left holding component 11 with the left side of the packing bag to an engaging portion of the right holding component 12 with the right side of the packing bag. The change of spacing distance can enable the packing bag to switch between the straightened state and the loosened state. Since the left and right holding components 11, 12 are drivingly connected and meshed with each other, only one of the left and right holding components 11, 12 needs to be driven to rotate, and the other can be automatically driven to rotate in the opposite direction. In this embodiment, a pushing part 23 is provided on the telescopic linkage bar 2 of the telescopic linkage mechanism. When the telescopic linkage bar 2 axially moves, the pushing part 23 pushes one of the left and right holding components 11, 12 to deflect, so as to adjust the spacing distance between the left and right holding components 11, 12. In an alternative embodiment, the telescopic linkage bar 2 may adopt a pushing part 23 which is rotatable around its axis to drive one of the left and right holding components 11, 12 to deflect, and the pushing part 23 may be of a cam structure. The telescopic control member of the telescopic linkage mechanism may adopt the combination of the telescopic control rack 41 and the telescopic control gear 42. When the telescopic linkage bar 2 may be driven to move axially, the telescopic control gear 42 and the telescopic linkage bar 2 are drivingly connected through a lead screw-nut pair for converting rotational motion into a linear motion. In this embodiment, the bag width adjusting mechanism is also provided, and includes a limiting member 51 and an elastic member 52. The limiting member 51 is adjustably connected to the modular pedestal 101 of the conveying module 100 for the packing machine in the sliding direction of the telescopic control rack 41. The elastic member 52 is provided between the telescopic control rack 41 and the modular pedestal 101, and acts on the telescopic control rack 41 to make the telescopic control rack 41 resiliently abut against the limiting member 51, so that the bag width adjusting mechanism is associated with the left and right holding components 11, 12 via the telescopic linkage mechanism, achieving the bag width adjustment while performing the bag deployed or retracted adjustment.

Figure 16:
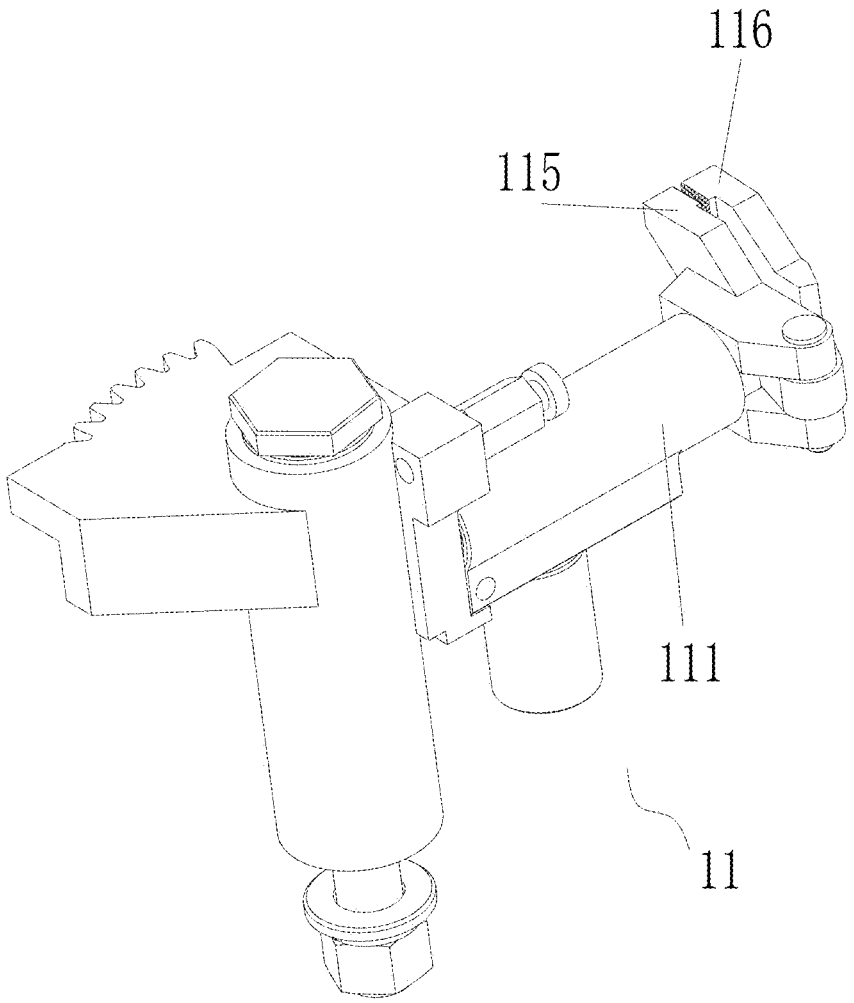
FIG. 16 is a schematic structural view of a left holding component in FIG. 13.
Figure 17:
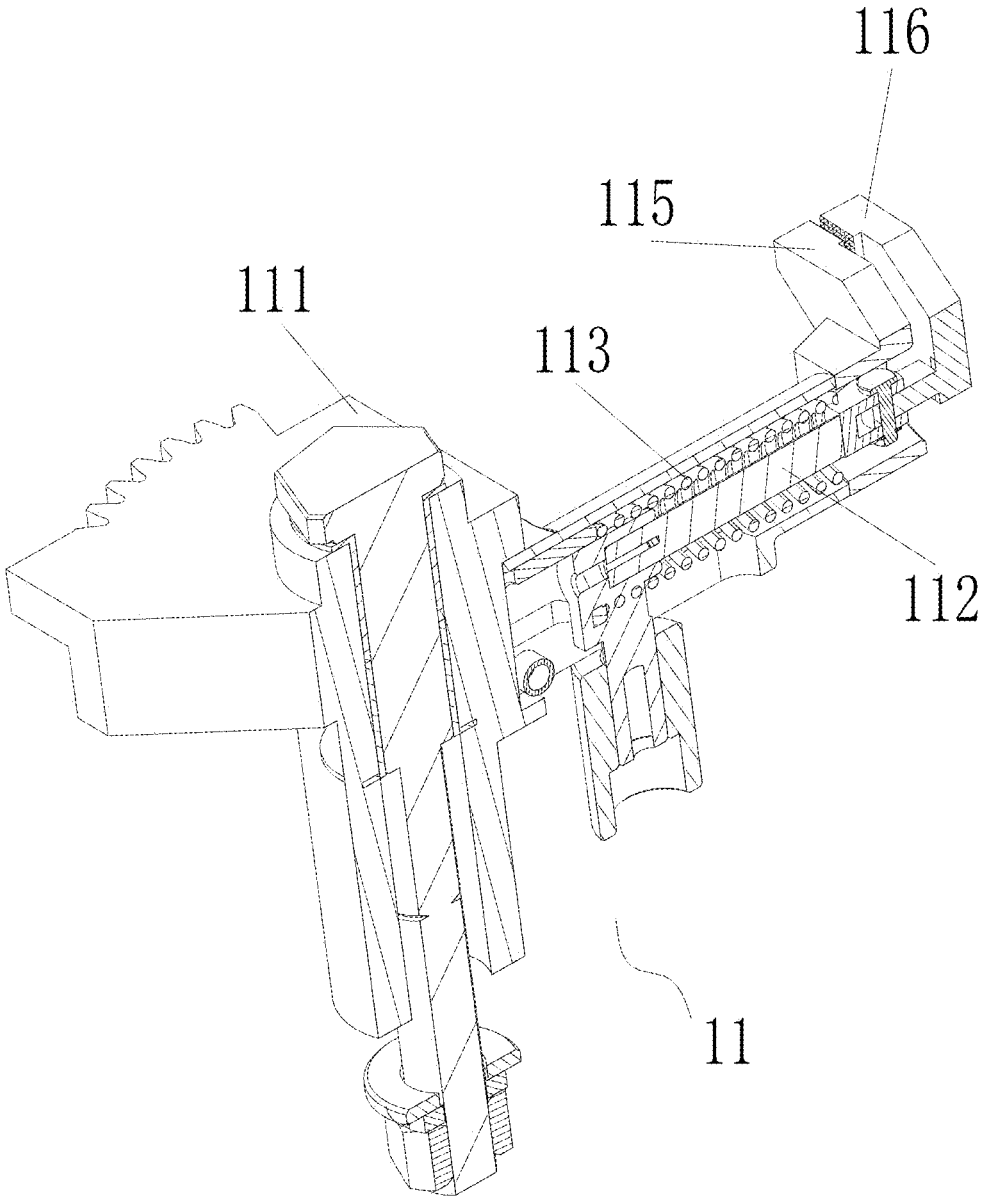
FIG. 17 is a schematic structural section view of FIG. 15.

In an embodiment as shown in FIGS. 16 and 17, each of the left and right holding components 11, 12 includes a jig primary body 111, a jig secondary body 112 slidably connected to the jig primary body 111, and a jig elastic member 113 provided between the jig primary body 111 and the jig secondary body 112. A first clamping plate 115 is fixedly connected with the jig primary body 111. A second clamping plate 116 is rotatably connected to the jig primary body 111, and is drivingly connected to the jig secondary body 112. The jig primary body 111 has a cylindrical cantilever portion, and the jig secondary body 112 is slidably arranged inside the cantilever portion. When the jig secondary body 112 slides relative to the jig primary body 111, the second clamping plate 116 is driven to rotate relative to the jig primary body 111. The first and second clamping plates 115, 116 cooperate to clamp the packing bag therebetween. In this embodiment, the clamping linkage mechanism includes clamping linkage bars 61 extending and arranged along the direction of arrangement of the holding units 1. An actuating part 62 is provided on the clamping linkage bar 61 and is associated with the left and right holding components 11, 12. The actuating part 62 may be a cam, and the clamping linkage bar 61 is rotatable around its axis to drive, via the actuating part 62, the left and right holding components 11, 12 synchronously to switch between the jig opened state and the jig closed state.

Figure 18:
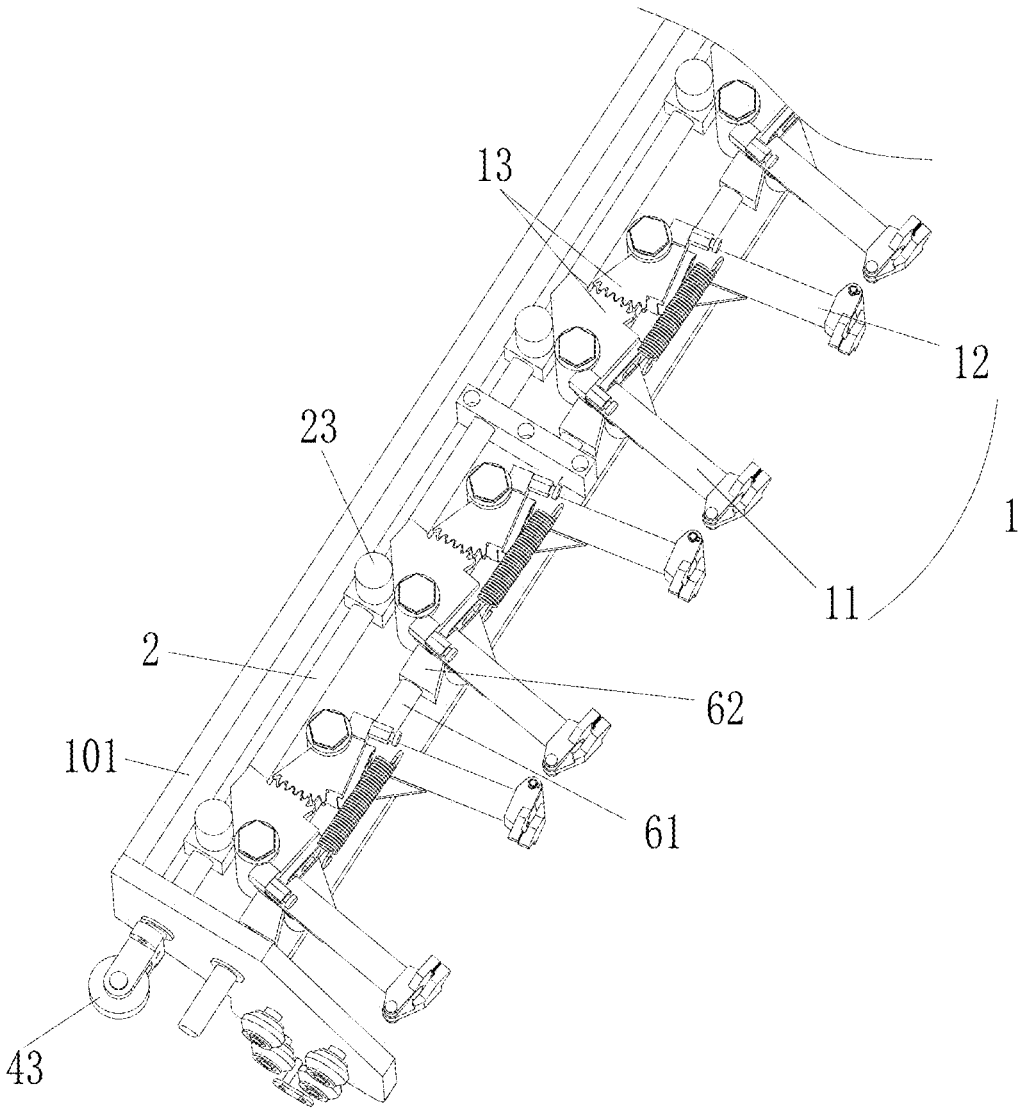
FIG. 18 is a schematic structural view of a part of another conveying module for a packing machine.

In an embodiment as shown in FIG. 18, it is different from the previous embodiment in that the telescopic control member of the telescopic linkage mechanism is the pushing part 43 provided at an end of the telescopic linkage bar 2 and configured to drive the telescopic linkage bar 2 to move in its axial direction, which is simple in structure and easy to implement. In this embodiment, the actuating part 62 provided on the clamping linkage bar 61 is in a wedge structure, and the clamping linkage bar 61 is movable in its axial direction so that the actuating part 62 can drive the left and right holding components 11, 12 to synchronously switch between the jig opened state and the jig closed state. In an alternative embodiment, it is also possible that the telescopic control member is a rocker arm connected to the telescopic linkage bar 2 for driving the telescopic linkage bar 2 to rotate around its axis.

Figure 21:
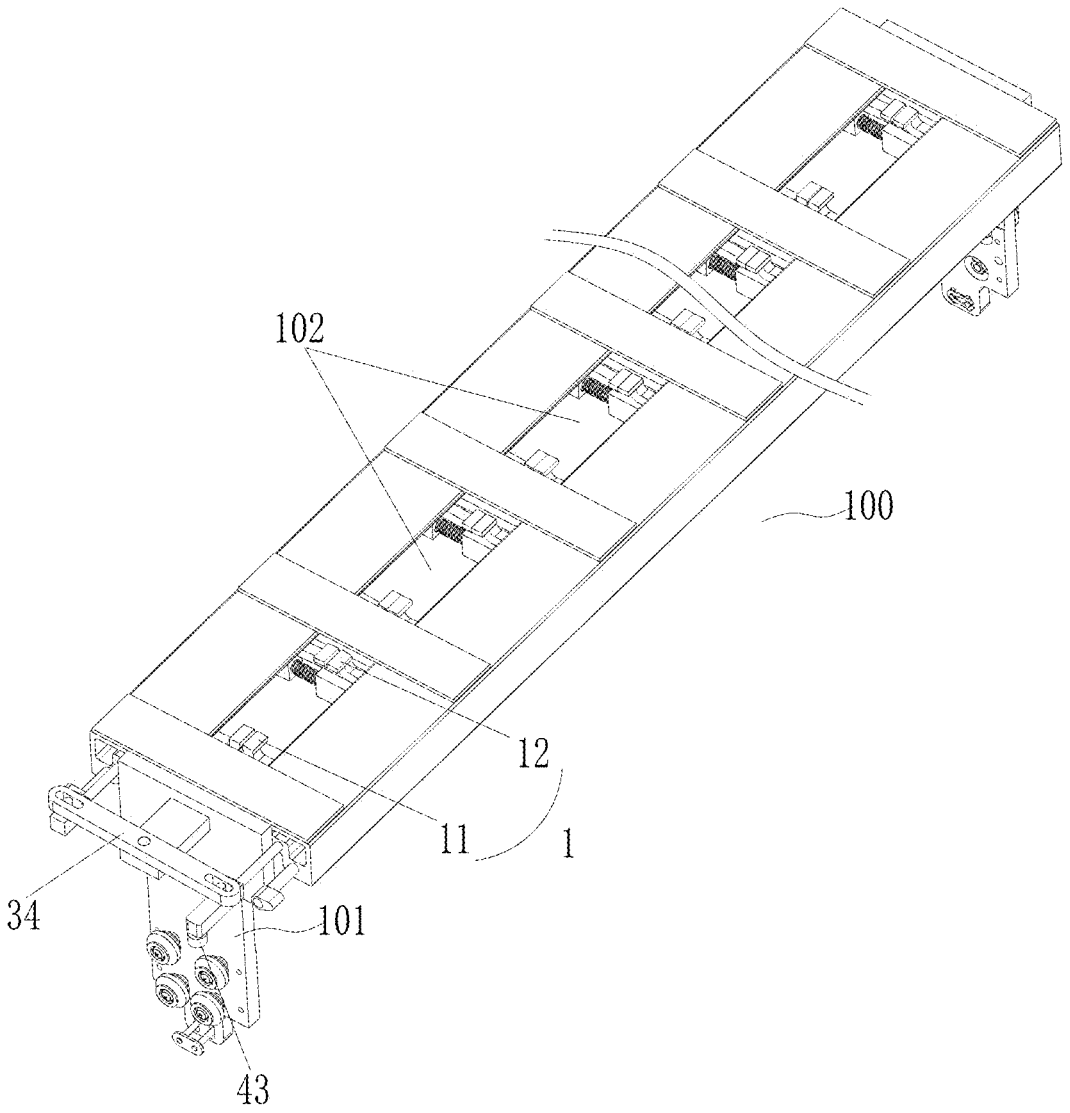
FIG. 21 is a schematic structural view of another conveying module for a packing machine.
Figure 22:
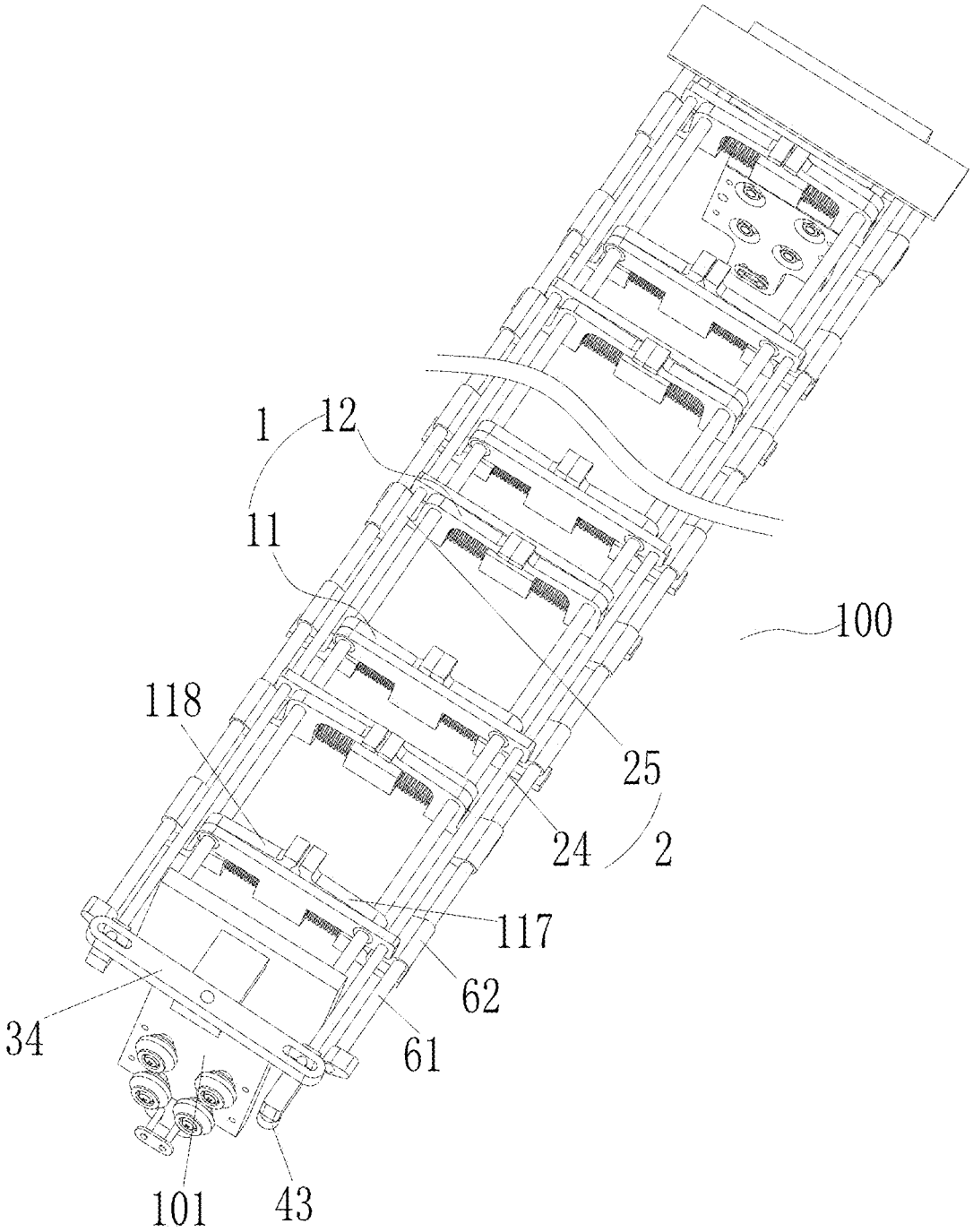
FIG. 22 is a schematic structural view of the conveying module for the packing machine as shown in FIG. 21 with a housing being omitted.
Figure 24:
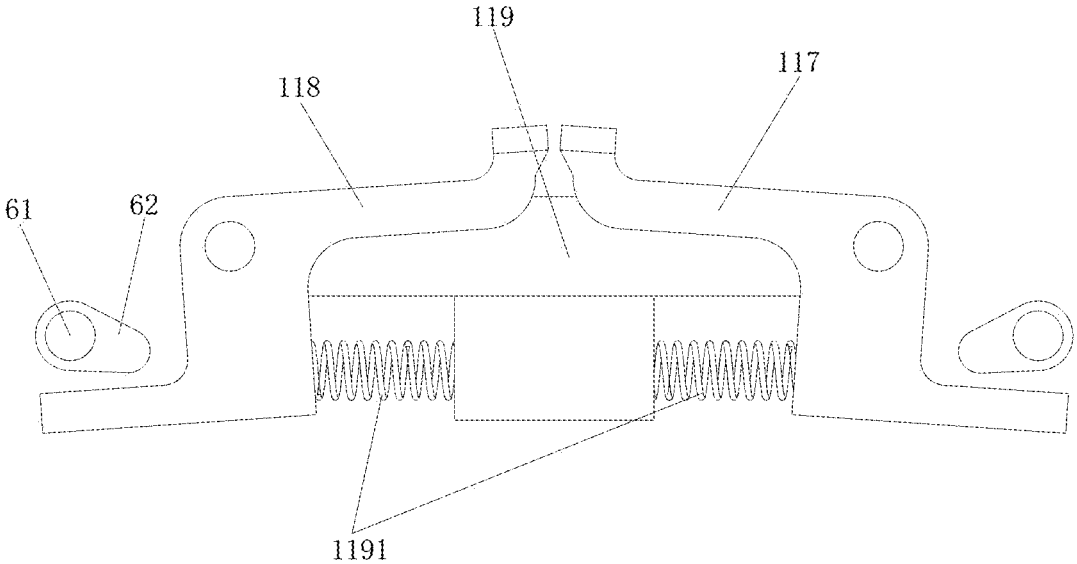
FIG. 24 is a schematic structural view of a first clamping part and a second clamping part in FIG. 22.

In an embodiment as shown in FIGS. 21 and 22, a receiving site 102 for placing the packing bag is provided on the modular pedestal 101 of the conveying module 100 for the packing machine at the middle in a direction perpendicular to the arrangement direction of the holding units 1. In other words, the packing bag is held by the holding unit 1 in the middle of the conveying module 100 for the packing machine, which adopts a symmetrical structure, is well-balanced, maintains the center of gravity in the middle of the conveying module 100 for the packing machine, and avoids the weight bias that leads to unstable movement of the conveying module 100 for the packing machine. In an embodiment, the telescopic linkage bar 2 includes the first and second linkage bars 24, 25 parallel to each other. The first linkage bar 24 is connected to the left holding component 11, and the second linkage bar 25 is connected to the right holding component 12. The first and second linkage bars 24, 25 move in opposite axial directions to adjust the spacing distance between the left and right holding components 11, 12. The first and second linkage bars 24, 25 are connected by a reverse linkage mechanism such that, when one of the first and second linkage bars 24, 25 moves axially in a direction, the reverse linkage mechanism drives the other of the first and second linkage bars 24, 25 to axially move in a reverse direction. The reverse linkage mechanism includes a toggle lever 34. The middle of the toggle lever 34 is rotatably connected to the modular pedestal 101 of the conveying module 100 for the packing machine. One end of the toggle lever 34 is drivingly connected to the first linkage bar 24 through a structure of groove-pin pair, and the other end of the toggle lever 34 is drivingly connected to the second linkage bar 25 through a structure of groove-pin pair. The axial movement of one of first and second linkage bars 24, 25 may drive, via the toggle lever 34, the other to move axially and oppositely. The telescopic control member of the telescopic linkage mechanism is the pushing part 43 arranged at the end of the first linkage bar 24 and configured to drive the first linkage bar 24 to move in its axial direction, which is simple in structure and easy to implement. Further, each of the left and right holding components 11, 12 of the holding unit 1 includes a first clamping part 117 and a second clamping part 118. The first and second clamping parts 117, 118 are respectively distributed on the two sides of the receiving site 102 in a direction perpendicular to the direction of arrangement of the holding units 1, that is, the first clamping part 117 is arranged on one side of the receiving site 102, and the second clamping part 118 is arranged on the other side of the receiving site 102. The first and second clamping parts 117, 118 are movable relative to each other to clamp the packing bag on the receiving site 102. In an embodiment, as shown in FIG. 24, each of the left and right holding components 11, 12 includes a clamping body 119. The first and second clamping parts 117, 118 each are rotatably arranged relative to the clamping body 119. A clamping elastic member 1191 is provided between the first clamping part 117 and the clamping body 119, and a clamping elastic member 1191 is provided between the second clamping part 118 and the clamping body 119. The use of the clamping elastic members 1191 enables the first and second clamping parts 117, 118 to automatically maintain in the jig closed state, which ensures the stability of clamping the packing bag. In this embodiment, the clamping linkage mechanism includes clamping linkage bars 61 extending and arranged along the arrangement direction of the holding units 1. Two clamping linkage bars 61 are provided in parallel to drive the first and second clamping parts 117, 118 respectively. The clamping linkage bar 61 is provided thereon the actuating part 62 associated with the left and right holding components 11, 12, and the actuating part 62 may be a cam. The clamping linkage bar 61 rotates around its axis to drive, via the actuating part 62, the first and second clamping parts 117, 118 to rotate, so that the left and right holding components 11, 12 are switched between the jig opened state and the jig closed state.

Figure 19:
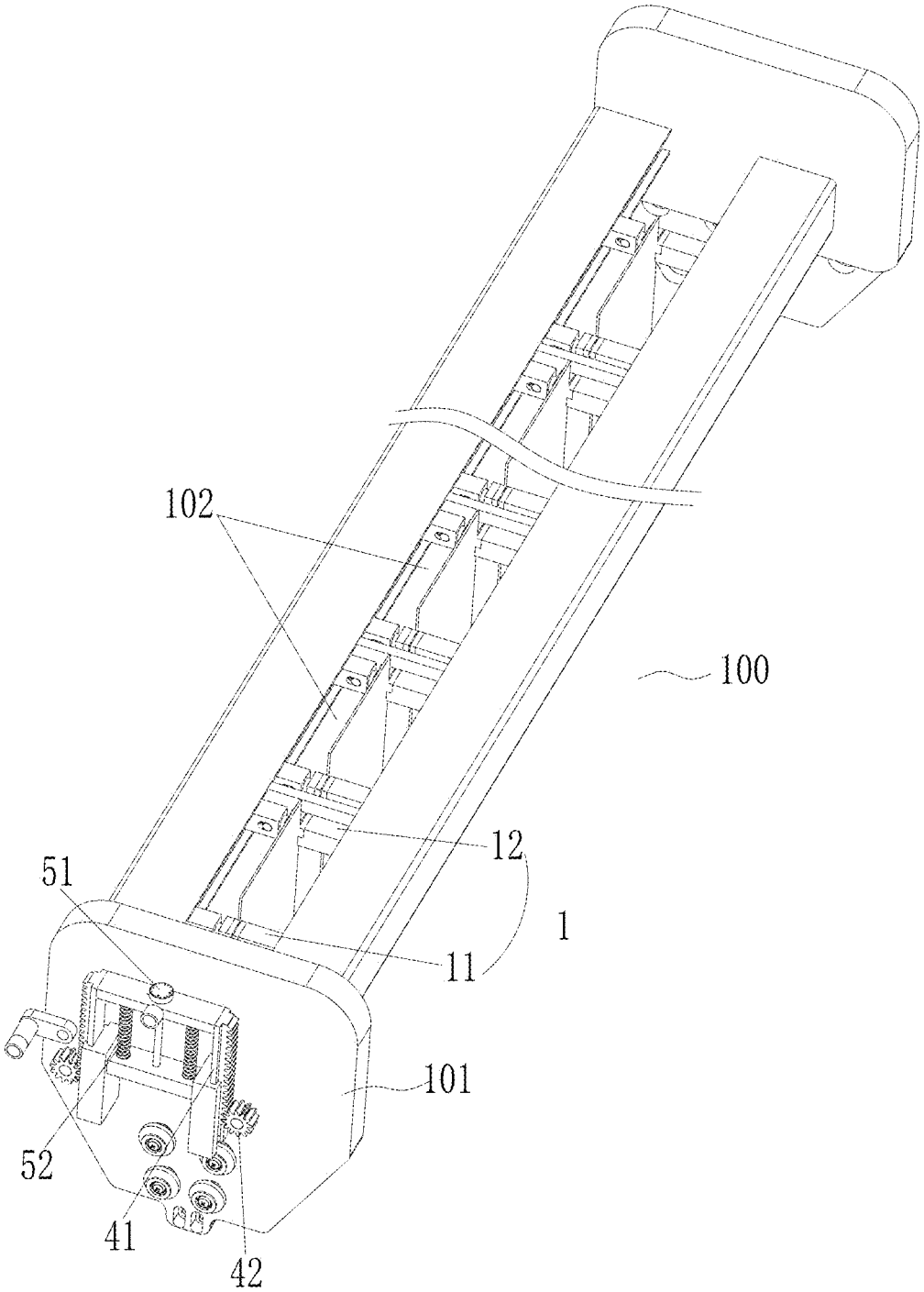
FIG. 19 is a schematic structural view of another conveying module for a packing machine.
Figure 20:
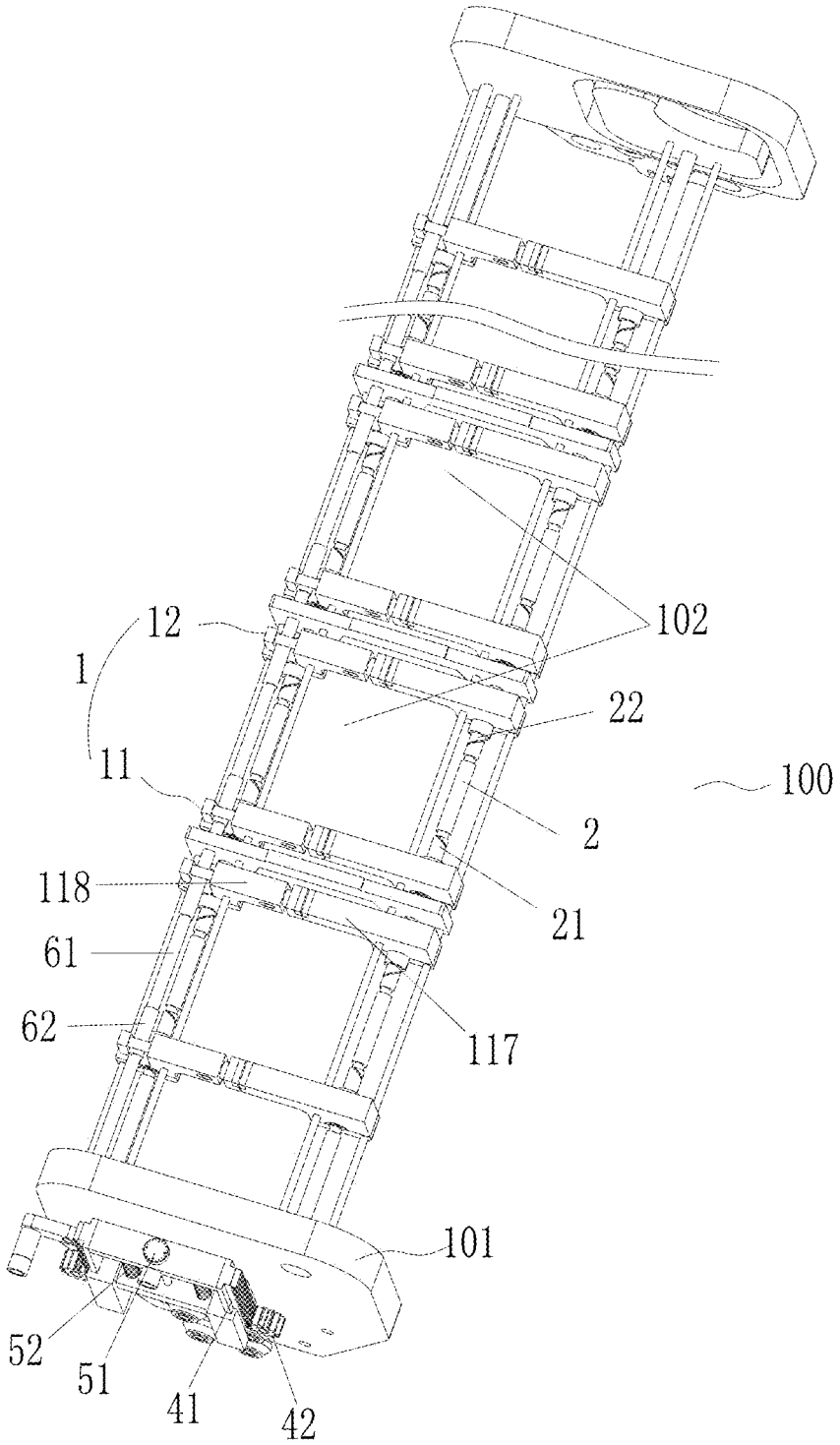
FIG. 20 is a schematic structural view of the conveying module for the packing machine as shown in FIG. 19 with a housing being omitted.
Figure 23:
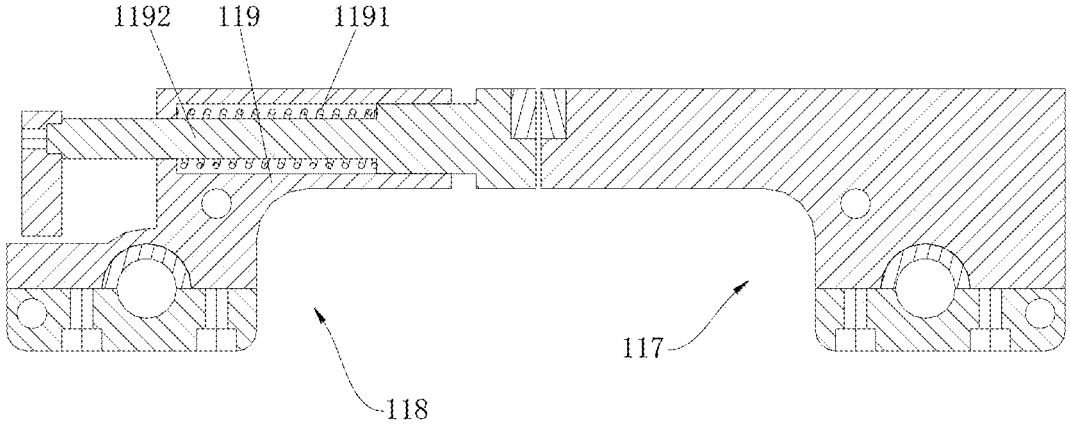
FIG. 23 is a schematic structural view of a first clamping part and a second clamping part in FIG. 20.

In an embodiment as shown in FIGS. 19 and 20, a symmetrical structure is also adopted, i.e., a receiving site 102 for placing the packing bag is provided on the modular pedestal 101 of the conveying module 100 for the packing machine at the middle in a direction perpendicular to the arrangement direction of the holding units 1. Each of the left and right holding components 11, 12 of the holding unit 1 includes a first clamping part 117 and a second clamping part 118. The first and second clamping parts 117, 118 are respectively distributed on the two sides of the receiving site 102 in a direction perpendicular to the direction of arrangement of the holding units 1. The first clamping part 117 is a fixed part that does not carry out a clamping action. As shown in FIG. 23, the second clamping part 118 includes a clamping body 119, a secondary clamping portion 1192 slidably connected to the clamping body 119, and a clamping elastic member 1191 provided between the clamping body 119 and the secondary clamping portion 1192. The secondary clamping portion 1192 moves towards the first clamping part 117 under the action of the clamping elastic member 1191, so as to claim the packing bag between the first clamping part 117 and the second clamping part 118. The clamping linkage bar 61 is provided thereon the actuating part 62 associated with the second clamping part 118 of the left and right holding components 11, 12, and the actuating part 62 may be a cam. The clamping linkage bar 61 rotates around its axis to drive, via the actuating part 62, the secondary clamping portion 1192 of second clamping part 118, so that the left and right holding components 11, 12 are switched between the jig opened state and the jig closed state. There are two telescopic linkage bars 2 in parallel. The telescopic linkage bar 2 is provided with a first threaded section 21 and a second threaded section 22 which are oppositely threaded. The first clamping part 117 and second clamping part 118 of the left holding component 11 is mounted on the first threaded section 21, and the first clamping part 117 and the second clamping part 118 of the right holding component 12 is mounted on the second threaded section 22. The telescopic linkage bar 2 rotates around its axis to move the left and right holding components 11, 12 in opposite axial directions of the telescopic linkage bar 2 so as to adjust the spacing distance.

Figure 25:
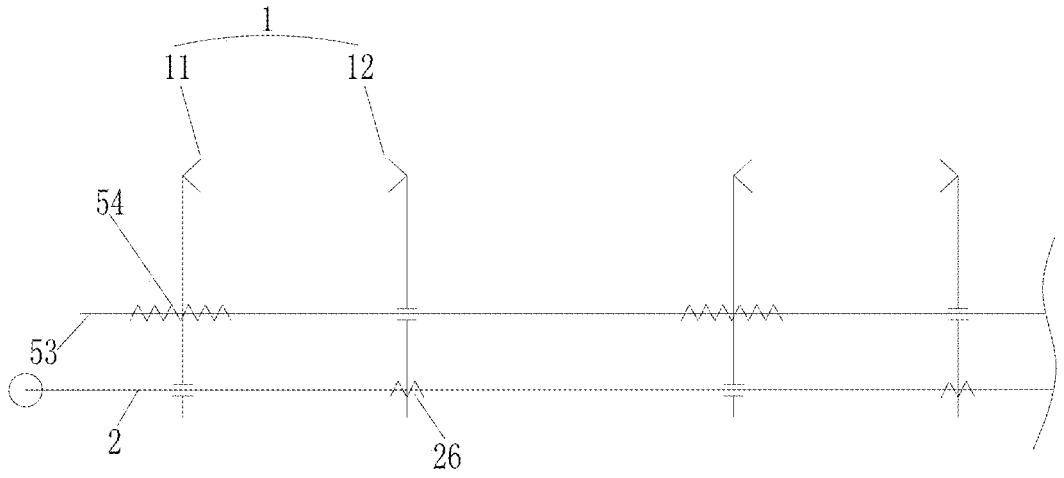
FIG. 25 is a schematic structural view of another conveying module for a packing machine.

In an embodiment as shown in FIG. 25, the telescopic linkage mechanism includes a telescopic linkage bar 2, and the bag width adjusting mechanism includes a bag width linkage bar 53 parallel to the telescopic linkage bar 2. The telescopic linkage bar 2 and the bag width linkage bar 53 each are an elongated bar extending in the direction of arrangement of the holding units 1. A short-stroke telescopic threaded section 26 is provided on the telescopic linkage bar 2, and a long-stroke bag width threaded section 54 is provided on the bag width linkage bar 53. The left holding component 11 is mounted on the bag width threaded section 54 of the bag width linkage bar 53 and is slidably engaged with the telescopic linkage bar 2, and the right holding component 12 is mounted on the telescopic threaded section 26 of the telescopic linkage bar 2 and is slidably engaged with the bag width linkage bar 53. As such, when the telescopic linkage bar 2 is rotated, the right holding component 12 can move transversely in a small range, whereas the left holding component 11 keeps still, so that the holding units 1 are synchronously switched between the bag deployed attitude and the bag retracted attitude. When the bag width linkage bar 53 is rotated, the left holding component 11 can move transversely in a long range, and the right holding component 12 keeps still, so as to significantly change the spacing distance of the left and right holding components 11, 12, thereby achieving the bag width adjustment to match the holding unit 1 with the packing bags of different sizes. In this embodiment, the telescopic linkage mechanism and the bag width adjusting mechanism are independent of each other. The bag width adjusting mechanism is not associated with the telescopic linkage mechanism, but is directly associated with the left holding component 11. The telescopic linkage mechanism and the bag width adjusting mechanism do not affect each other, and can be adjusted independently of each other. The movement of the bag width adjusting mechanism does not affect the movement of the telescopic linkage mechanism, so there is no need to adaptively adjust the telescopic drive mechanism cooperated with the telescopic linkage mechanism.

Figure 26:
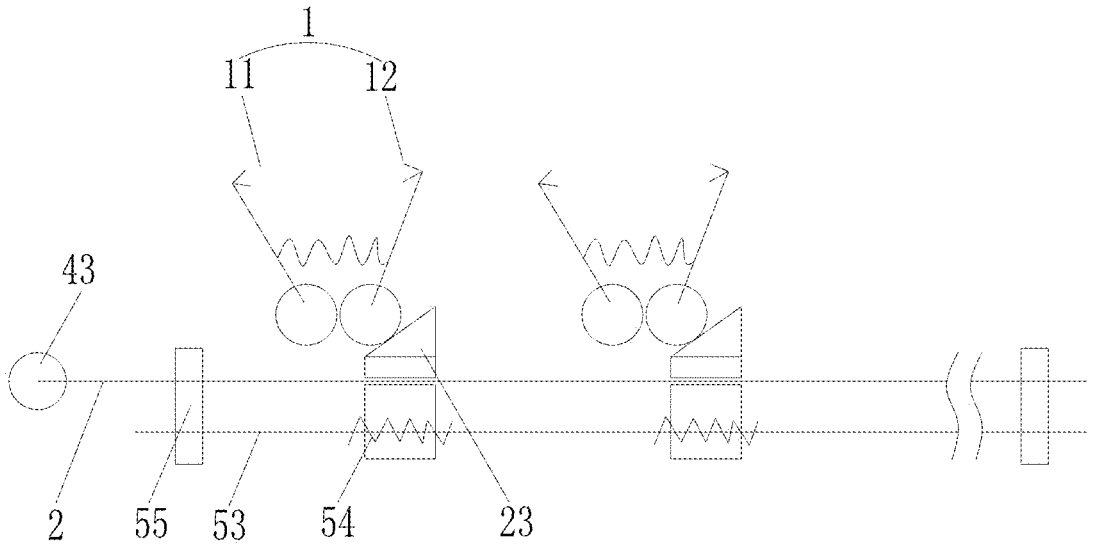
FIG. 26 is a schematic structural view of another conveying module for a packing machine.

In an embodiment as shown in FIG. 26, the left and right holding components 11, 12 are each rotatably arranged on the modular pedestal, and are each provided with a gear part so that they are meshingly connected with each other. The pushing part 23 is provided on the telescopic linkage bar 2 of the telescopic linkage mechanism. When the telescopic linkage bar 2 axially moves, the pushing part 23 pushes the right holding component 12 to deflect, and the left holding component 11 may automatically be driven to rotate in a reverse direction since the left and right holding components 11, 12 are meshingly connected with each other, thereby achieving adjustment of the spacing distance between the left and right holding components 11, 12, i.e., achieving the synchronous switch of the holding units 1 between the bag deployed attitude and the bag retracted attitude. The bag width adjusting mechanism is further provided in this embodiment, and includes a bag width linkage bar 53 parallel to the telescopic linkage bar 2. A coupling block 55 is fixedly provided on the telescopic linkage bar 2, and the bag width linkage bar 53 is rotatably connected to the coupling block 55. The bag width linkage bar 53 is provided with a bag width threaded section 54. The pushing part 23 is slidably connected to the telescopic linkage bar 2, and is further mounted on the bag width threaded section 54, so that the position of the pushing part 23 may be adjusted in the axial direction of the telescopic linkage bar 2 by rotating the bag width linkage bar 53. When the position of the pushing part 23 is changed, it may pushes the right holding component 12, so as to change the spacing distance between the left and right holding components 11, 12, thereby achieving the bag width adjustment to enable the holding unit 1 to adapt to the packing bags of different sizes. In this embodiment, the bag width adjusting mechanism does not hinder the action of the telescopic linkage mechanism. After the bag width adjusting mechanism carries out the bag width adjustment, the telescopic linkage mechanism still can adjust reliably and normally the spacing distance between the left and right holding components 11, 12 in a small range, ensuring the stable and reliable packing processing while matching the packing bags of different sizes. And, in this embodiment, after carrying out the bag width adjustment, the pushing part 43 at the end of the telescopic linkage bar 2 does not change, so the telescopic drive mechanism cooperated with the telescopic linkage mechanism does not need to be adaptively adjusted.

Figure 27:
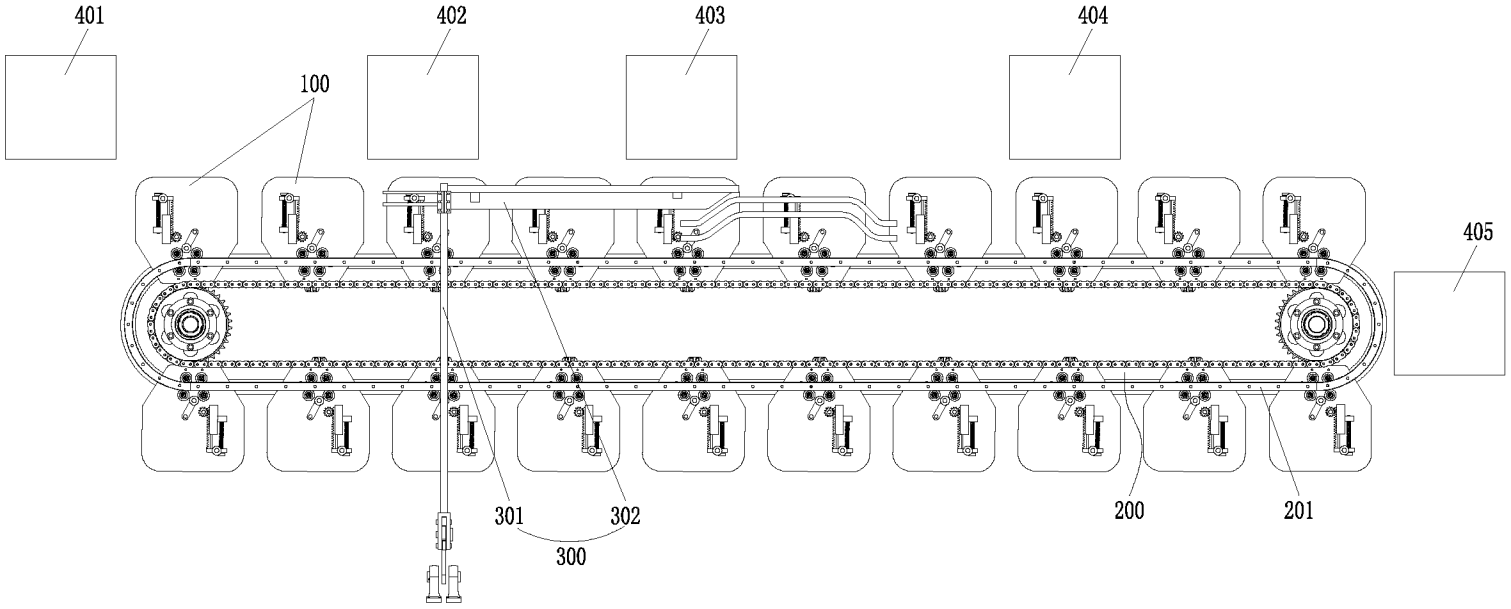
FIG. 27 is a schematic structural view of a packing machine.

As shown in FIG. 27, a packing machine includes the conveying device for the packing machine mentioned above, and several operating mechanisms for carrying out different packaging processing operations respectively. The operating mechanisms are respectively provided at various preset stations on the conveying path of the conveying device for the packing machine. For the packing machine, it is necessary to carry out the packaging processing operations such as bag loading, opening, filling, sealing and discharging. Generally, during these packaging processing operations, the packing bag needs to be in a static state, and thus the circulating conveyor mechanism 200 is an intermittently moving conveyor mechanism in which the circulating conveyor mechanism 200 drives the conveying module 100 for the packing machine to intermittently travel. Several preset stations are provided on the conveying path of the circulating conveyor mechanism 200, and the operating mechanisms for carrying out various packaging processing operations are provided at the preset stations. The conveying module 100 for the packing machine is driven by the circulating conveyor mechanism 200 to move to and stop at the individual preset stations for carrying out the respective packaging processing operations by the respective operating mechanisms.

In an embodiment, the operating mechanisms include a bag loading mechanism 401, a bag opening mechanism 402, a filling mechanism 403, a sealing mechanism 404, a discharging mechanism 405, etc. Each operating mechanism includes operating units, the number of which corresponds to the number of the holding units 1 of the conveying module 100 for the packing machine, thereby efficiently realizing multi-station packaging processing and effectively improving the packaging processing efficiency. The bag loading mechanism 401 is configured to place the packing bag stored in the bag compartment onto the holding unit 1 of the conveying module 100 for the packing machine. The bag opening mechanism 402 is configured to open the mouth of the packing bag to prepare for subsequent filling. The filling mechanism 403 is configured to fill material into the packing bag. The sealing mechanism 404 is configured to seal the mouth of the packing bag. The discharging mechanism 405 is configured to receive the processed packing bag filled with material for discharging.

Further, the circulating conveyor mechanism 200 of the packing machine needs to carry out conveying action. The conveying module 100 for the packing machine needs to carry out the bag deployed and retracted actions and the camp opened and closed actions. The various operating mechanisms also need to carry out various packaging processing actions. The packing machine needs a power system to drive the various assemblies to carry out the actions. If the separate power drive mechanisms are adopted for the various assemblies respectively, when one of the power drive mechanism fails, it will affect adversely the operation of the entire packaging machine and even cause serious problems. Therefore, the packaging machine preferably adopts a linked power system. In an embodiment, a power system includes a total power source, power distribution mechanism and several cam drive mechanisms. The total power source may be a motor, an engine, etc. The power distribution mechanism is drivingly connected to the total power source to distribute the power of the total power source, and includes a continuous power output end for outputting power for continuous actions, and an intermittent power output end for outputting power for intermittent actions. The intermittent power output end is drivingly connected to the circulating conveyor mechanism 200, so that the circulating conveyor mechanism 200 drives the conveying module 100 for the packing machine to intermittent travel. The conveying module 100 for the packing machine is driven by the circulating conveyor mechanism 200 to move to and stop at the preset station for carrying out the packing processing operation by the operating mechanism. Then, the circulating conveyor mechanism 200 further drives the conveying module 100 for the packing machine to continuously move. The continuous power output end is drivingly connected to the various operating mechanisms through corresponding cam drive mechanisms. The various operating mechanisms are driven by the cam drive mechanisms, so as to carry out high-precision cooperation with the intermittent traveling conveying module 100 for the packing machine, ensuring the stability and accuracy of the packaging processing. Preferably, the cam drive mechanisms are connected in series to form a series transmission structure. In this way, when one transmission link fails, the entire power system will stop, effectively avoiding occurrence of interference or impact of the various moving mechanisms of the packing machine, and avoiding the expansion of accidental damage so as to facilitate rapid maintenance to resume production operations.

Figure 28:
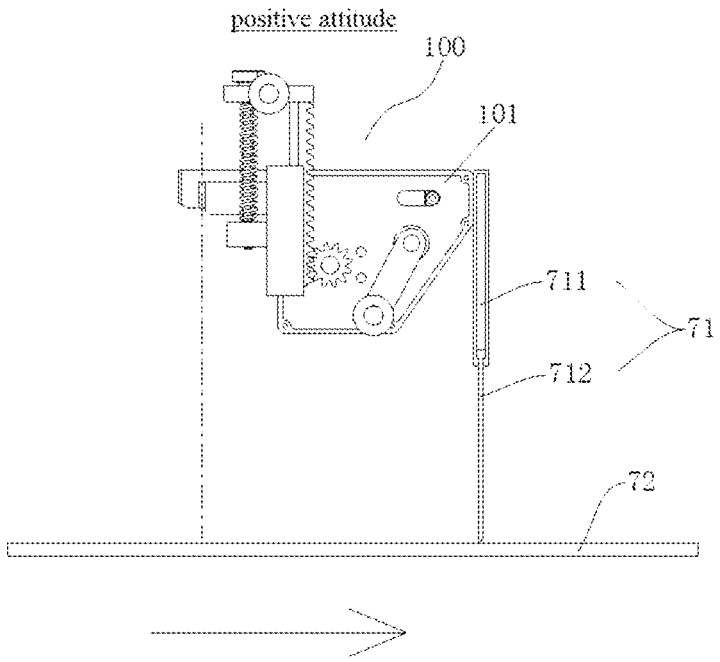
FIG. 28 is a schematic structural side view of a conveying module for a packing machine in a positive attitude.
Figure 29:
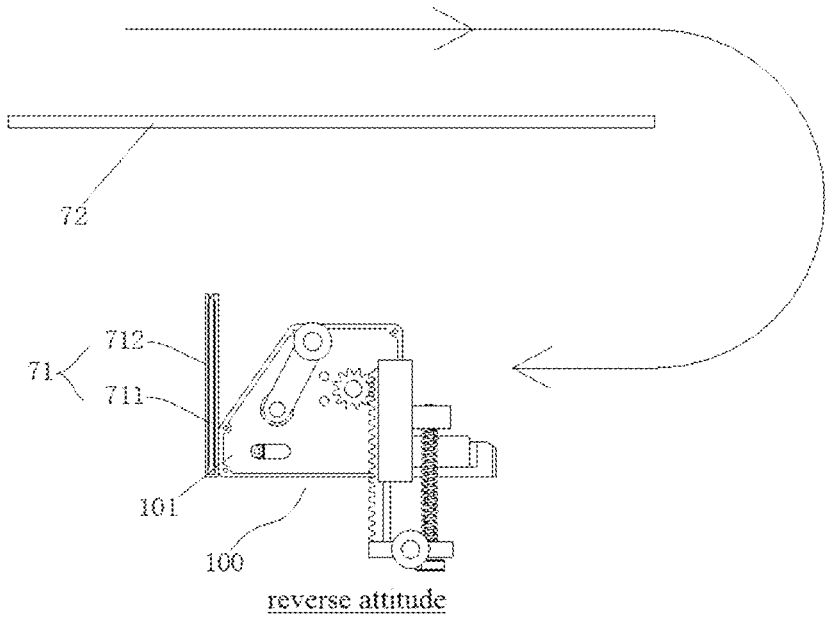
FIG. 29 is a schematic structural side view of a conveying module for a packing machine in a reverse attitude.

In the packaging process, if there is a mechanical failure or communication failure, leakage of materials may occur. That is, the following situations may occur: the packing bag is not placed onto the holding unit; the packing bag falls off from the holding unit; material is leaked out when filling material; etc. Occurrence of these situations may be caused by the conveying module for the packing machine not traveled in place, failure of the left and right holding components of the holding unit, the ineffectively opened mouth of the packing bag due to inadequate retracted attitude so that the material is difficult to be precisely and fully loaded in the packing bag, etc. the packing bag and material falling in apparatuses of the packing machine may affect the normal operation of the packing machine, resulting in damage to the apparatuses, contamination and so on. To clean up the fallen packing bag and material, as shown in FIGS. 28 and 29, a scraping mechanism 71 is further provided on the modular pedestal 101 of the conveying module 100 for the packing machine. The conveying module 100 for the packing machine is driven by the circulating conveyor mechanism to travel. Thus, a baffle 72 may be provided below the traveling path of the conveying module 100 for the packing machine, so that the fallen packing bag and material may fall on the baffle 72. The baffle 72 serves as a receiver for receiving the fallen packing bag and material. The scraping mechanism 71 may travel along with the conveying module 100 for the packing machine, and scrape along the baffle 72 so that the packing bag and material on the baffle 72 may be swept and collected along the traveling direction of the conveying module 100 for the packing machine. Preferably, a collection mechanism 73 may be provided at the tail end of the baffle 72 in the traveling direction of the conveying module 100 for the packing machine to collect the packing bag and material. When the conveying module 100 for the packing machine travels, the scraping mechanism 71 sweeps and pushes the packing bag and material onto the collection mechanism 73. The collection mechanism 73 may be a container of a certain volume which may temporarily store the packing bag and material and then be periodically cleaned up. Alternatively, the collection mechanism 73 may be a conveyer belt, and the packing bag and material may be pushed onto the conveyer belt and then be conveyed to the outside of the packing machine through the conveyer belt in real time. In an embodiment, the conveying direction of the conveyer belt is perpendicular to the direction of travel of the conveying module 100 for the packing machine.

In a preferred embodiment as shown in FIGS. 28 and 29, the scraping mechanism 71 includes a stationary element 711 connected to the modular pedestal 101, and a sliding element 712 slidably connected to the stationary element 711. That is, the scraping mechanism 71 is of a telescopic structure, which can be retracted and deployed. Specifically, when the packing machine runs normally, the sliding element 712 is retracted in the stationary element 711, so as to prevent the sliding element 712 from continuously acting on the baffle 72 to cause wear of the sliding element 712, and thus reduce the difficulty of collecting and removing all the leaked material when material is leaked later. That is, switch between the retraction and deployment of the craping mechanism 71 is controllable. When there is no leakage, the scraping mechanism 71 is always in the retracted state. Only when there is leakage, the scraping mechanism 71 is switched to the deployed state to carry out cleaning.

In a preferred embodiment, when the conveying module 100 for the packing machine is in a preset positive attitude, the sliding element 712 automatically slides relative to the stationary element 711 to be switched to a deployed state. When the conveying module 100 for the packing machine is in a preset reverse attitude, the sliding element 712 automatically slides relative to the stationary element 711 to be switched to a retracted state. In an embodiment, the conveying path of the circulating conveyor mechanism is oblong, and the plane where the conveying path is located is oriented vertically. The conveying path of the circulating conveyor mechanism includes arc sections and straight sections. The two straight sections are parallel to the horizontal plane and are distributed in the up and down direction, and the ends of the two straight sections are connected through the respective arc sections, so that the conveying module 100 for the packing machine annularly travels along a circular path. When the conveying module 100 for the packing machine is at the upper straight section, the conveying module 100 for the packing machine is in the preset positive attitude. When the conveying module 100 for the packing machine is at the lower straight section, the conveying module 100 for the packing machine is in a preset reverse attitude. The conveying module 100 for the packing machine in the reverse attitude is in an upside-down state relative to the conveying module 100 for the packing machine in the positive attitude. The sliding element 712 and the stationary element 711 of the scraping mechanism 71 are in a freely slidable state. When the conveying module 100 for the packing machine switches between the positive attitude and the reverse attitude, the sliding element 712 automatically slides relative to the stationary element 711 under the action of gravity to switch between the deployed state and the retracted state. When the conveying module 100 for the packing machine is in the preset positive attitude, the scraping mechanism automatically switches to the deployed stated under the action of gravity, and the sliding element 712 slides out of the stationary element 711, so that the sliding element 712 can effectively cooperate with the baffle 72 below the traveling path of the conveying module 100 for the packing machine, thereby reliably realizing the function of cleaning and the function of intensively collecting of the leaking material. Preferably, when the scraping mechanism 71 is in the deployed state, the sliding element 712 can be in contact with the upper surface of the baffle 72, so as to adequately clean and push the materials on the baffle 72. In an embodiment, the sliding element 712 may be provided with brushes to contact with the baffle 72, not only ensuring the adequacy of the cleaning, but also avoiding excessive friction resistance from generating due to contact between the sliding element 712 and the baffle 72 to hinder the normal traveling of the conveying module 100 for the packing machine. When the conveying module 100 for the packing machine is in a present reverse attitude, the scraping mechanism automatically switches to the retracted state under the action of gravity, and the sliding element 712 slides into the stationary element 711, reducing the occupied space, especially, facilitating reduction of the spacing distance between the two straight sections of the circulating conveyor mechanism. It is possible to avoid interference in the process of traveling of the conveying module for the packing machine, and the structure is highly compact, which is conducive to increasing the compactness of the packaging machine as a whole and reducing the volume of the equipment.

The foregoing only relates to the preferred embodiments of the present application. It should be noted that the above preferred embodiments should not be regarded as limitation to the present application, and the scope of protection of the present application should be limited by the claims. For the person of ordinary skill in the art, without departing from the spirit and scope of the present application, many improvements and modifications may be made, and these improvements and modifications should also fall within the scope of protection of the present application.

The invention claimed is:

1. A conveying module for a packing machine, comprising a modular pedestal, wherein a telescopic linkage mechanism and at least two holding units are provided on the modular pedestal, the holding units are arranged in parallel for placing packing bags, each holding unit comprises a left holding component and a right holding component which are configured to be engaged with sides of the packing bag and are movable relative to each other, the telescopic linkage mechanism is configured to enable the left holding components and the right holding components to move relative to each other, so as to drive all the holding units to synchronously switch between a bag deployed attitude and a bag retracted attitude, and a spacing distance between the left holding component and the right holding component in the bag deployed attitude is larger than that in the bag retracted attitude, wherein a bag width adjusting mechanism is provided on the modular pedestal, and is associated with at least one of the left holding component and the right holding component to synchronously adjust the spacing distance between the left holding component and the right holding component of each holding unit to adapt to packing bags of different sizes, wherein the bag width adjusting mechanism is associated with the telescopic linkage mechanism, and is associated with at least one of the left holding component and the right holding component via the telescopic linkage mechanism, and wherein the bag width adjusting mechanism comprises a limiting member and an elastic member, the limiting member is adjustably connected to the modular pedestal of the conveying module for the packing machine, and the elastic member is configured to act on a telescopic control member of the telescopic linkage mechanism to enable the telescopic control member to elastically abut against the limiting member.

2. The conveying module for the packing machine according to claim 1, wherein the telescopic linkage mechanism comprises telescopic linkage bars and a telescopic control member, the telescopic linkage bars extend and are arranged along a direction of arrangement of the holding units, each telescopic linkage bar is associated with at least one of the left holding component and the right holding component, the telescopic control member is drivingly connected to the telescopic linkage bar, so as to drive the telescopic linkage bar to rotates around its axis or move in its axial direction, thereby causing relative movement of the left holding component and the right holding component.

3. The conveying module for the packing machine according to claim 2, wherein each telescopic linkage bar is provided with a first threaded section and a second threaded section which are oppositely threaded, the left holding component is mounted on the first threaded section, the right holding component is mounted on the second threaded section, the telescopic linkage bar is configured to rotate around its axis to enable opposite movements of the left holding component and the right holding component in an axial direction of the telescopic linkage bar; or each telescopic linkage bar comprises a first linkage bar and a second linkage bar parallel to each other, the first linkage bar is connected to the left holding component, the second linkage bar is connected to the right holding component, the left holding component is slidably engaged with the second linkage bar, the right holding component is slidably engaged with the first linkage bar, the first linkage bar and the second linkage bar are movable in opposite axial directions; or each telescopic linkage bar is provided thereon with a pushing part, and the pushing part is configured to, when rotating around its axis or moving axially, push one of the left holding component and the right holding component to move.

4. The conveying module for the packing machine according to claim 3, wherein the first linkage bar and the second linkage bar are connected through a reverse linkage mechanism such that, when one of the first linkage bar and second linkage bar moves axially, the other of the first linkage bar and second linkage bar is driven by the reverse linkage mechanism to move axially in a reverse direction.

5. The conveying module for the packing machine according to claim 4, wherein the reverse linkage mechanism comprises a first rack, a second rack and a first gear, the first linkage bar is connected to the first rack, the second linkage bar is connected to the second rack, a length direction the first rack and the second rack is in accord with a direction of axis of the first linkage bar and the second linkage bar, the first rack and the second rack are space apart in parallel, the first gear is arranged between and meshed with the first rack and the second rack; or the reverse linkage mechanism comprises a toggle lever, a middle of the toggle lever is rotatably connected to the modular pedestal of the conveying module for the packing machine, one end of the toggle lever is drivingly connected to the first linkage bar through a structure of a groove-pin pair, the other end of the toggle lever is drivingly connected to the second linkage bar through a structure of a groove-pin pair.

6. The conveying module for the packing machine according to claim 2, wherein the telescopic control member comprises a telescopic control rack and a telescopic control gear, the telescopic control rack is slidably arranged on the modular pedestal of the conveying module for the packing machine, the telescopic control gear is rotatably arranged on the modular pedestal, the telescopic control rack and the telescopic control gear are meshed with each other, the telescopic control gear is drivingly connected to the telescopic linkage bar such as to drive the telescopic linkage bar to rotate around its axis or move in its axial direction.

7. The conveying module for the packing machine according to claim 6, wherein the limiting member is adjustably connected to the modular pedestal of the conveying module for the packing machine in a sliding direction of the telescopic control rack, the elastic member is arranged between the telescopic control rack and the modular pedestal, and enables the telescopic control rack to elastically abut against the limiting member.

8. The conveying module for the packing machine according to claim 1, wherein the left holding component and the right holding component each are a jig, a clamping linkage mechanism is provided on the conveying module for the packing machine, the clamping linkage mechanism is configured to drive the left holding components and the right holding components of all of the holding units to synchronously switch between a jig opened state and a jig closed state, the clamping linkage mechanism comprises clamping linkage bars extending and arranged along a direction of arrangement of the holding units, each clamping linkage bar is provided thereon with an actuating part associated with the left holding component and the right holding component, the actuating part is configured to, when the clamping linkage bar rotates around its axis or moves axially, drive the left holding component and the right holding component to synchronously switch between the jig opened state and the jig closed state.

9. The conveying module for the packing machine according to claim 1, wherein a scraping mechanism is further provided on the modular pedestal.

10. The conveying module for the packing machine according to claim 9, wherein the scraping mechanism comprises a stationary element and a sliding element, the stationary element is connected to the modular pedestal, the sliding element is slidably connected to the stationary element;

when the conveying module for the packing machine is in a preset positive attitude, the sliding element automatically slides relative to the stationary element and switches to a deployed state; when the conveying module for the packing machine is in a preset reverse attitude, the sliding element automatically slides relative to the stationary element and switches to a retracted state.

11. A conveying device for a packing machine, comprising the conveying module for the packing machine according to claim 1, and a circulating conveyor mechanism, wherein the conveying module for the packing machine is provided on the circulating conveyor mechanism such as to be driven by the circulating conveyor mechanism to circularly travel, and a telescopic drive mechanism is provided beside the circulating conveyor mechanism and in configured to drive the telescopic linkage mechanism.

12. The conveying device for the packing machine according to claim 11, wherein the telescopic drive mechanism comprises a power actuating mechanism, or a guiding member provided along a conveying path of the circulating conveyor mechanism, or combination thereof.

13. The conveying device for the packing machine according to claim 12, wherein the power actuating mechanism comprises a toggle member and a power assembly, the toggle member is adjustably connected to and driven by the power assembly;

the toggle member comprises two toggle levers spaced apart and parallel to a conveying direction of the circulating conveyor mechanism;

the toggle member comprises a hoop part, the power assembly comprises a tie rod, the hoop part is adjustably connected to and surrounds the tie rod;

the guiding member comprises a guide rail or a guide groove, the guiding member is adjustably arranged beside the circulating conveyor mechanism.

* * * * *